US012747058B2

(12) United States Patent
Kurane et al.

(10) Patent No.: US 12,747,058 B2
(45) Date of Patent: Sep. 29, 2026

(54) ITEM PACKAGING MACHINE WITH LONGITUDINAL AND LATERAL PACKAGE SIZING

(71) Applicant: Tension International, Inc., Kansas City, MO (US)

(72) Inventors: Sameer Kurane, Irvine, CA (US); Nicholas Long, Aurora, CO (US); Lexi Wightman, Aurora, CO (US); Anthony Barone, Aurora, CO (US)

(73) Assignee: Tension International, Inc., Kansas City, MO (US)

( * ) Notice: Subject to any disclaimer, the term of this patent is extended or adjusted under 35 U.S.C. 154(b) by 0 days.

(21) Appl. No.: 19/075,549

(22) Filed: Mar. 10, 2025

(65) Prior Publication Data

US 2025/0282513 A1 Sep. 11, 2025

Related U.S. Application Data

(60) Provisional application No. 63/563,440, filed on Mar. 10, 2024.

(51) Int. Cl.
*B65B 51/30* (2006.01)
*B65B 9/02* (2006.01)
(Continued)

(52) U.S. Cl.
CPC ..... *B65B 59/003* (2019.05); *B65B 9/02* (2013.01); *B65B 41/14* (2013.01); *B65B 51/30* (2013.01); *B65B 61/10* (2013.01)

(58) Field of Classification Search
CPC ..... B65B 9/02; B65B 41/14; B65B 51/30; B65B 61/04
See application file for complete search history.

(56) References Cited

U.S. PATENT DOCUMENTS 3,191,356 A * 6/1965 Zelnick ..... B65B 51/303 100/906
4,035,983 A * 7/1977 Shanklin ..... B65B 9/06 53/76

(Continued)

FOREIGN PATENT DOCUMENTS

CN 102774518 A 11/2012
CN 207374738 U 5/2018

(Continued)

OTHER PUBLICATIONS

BVM Brunner Gmbh & Co. KG, Compacta 7515 Speedy Electronically-Controlled Sealing Stamp DRIVE, BVM web-page, accessed Jun. 30, 2025, Reutlingen Germany.

*Primary Examiner* — Gloria R Weeks
(74) *Attorney, Agent, or Firm* — AVEK IP, LLC; Kent R. Erickson

(57) ABSTRACT

An item packaging machine includes an induction conveyor module, a height sizing conveyor module, a first sealing assembly, a package draw conveyor module, a width trim conveyor module, and a second sealing assembly. A gripper assembly comprising a gripping device is configured to engage an unsealed side of the package and move downward to pull a package laterally across a conveyor run of the width trim conveyor module from a first side thereof to a second side thereof. The package is pulled to a position that corresponds to a width of the order. The second sealing module is positioned between the conveyor run and the gripper assembly and is configured to cut and to seal the unsealed side of the package after the package has been pulled to the position that corresponds to the width of the order.

21 Claims, 16 Drawing Sheets

(51) Int. Cl.

| | |
|---|---|
| ***B65B 41/14*** | (2006.01) |
| ***B65B 59/00*** | (2006.01) |
| ***B65B 61/04*** | (2006.01) |
| ***B65B 61/10*** | (2006.01) |

(56) References Cited

U.S. PATENT DOCUMENTS 4,219,988 A * 9/1980 Shanklin ..... B29C 66/4322 53/374.6
5,015,325 A * 5/1991 Bennett ..... B29C 66/8161 493/203
5,444,964 A * 8/1995 Hanagata ..... B29C 65/749 53/550
5,653,085 A * 8/1997 Suga ..... B29C 66/91212 53/550
5,956,931 A * 9/1999 Stork ..... B65B 59/001 53/550
6,817,163 B2 * 11/2004 Limousin ..... B65B 59/001 53/550
6,895,732 B2 * 5/2005 Sperry ..... B65B 51/12 53/553
6,962,033 B2 * 11/2005 Guzman ..... B29C 66/8242 53/550
7,143,569 B2 * 12/2006 Limousin ..... B65B 9/067 53/64
8,272,196 B2 * 9/2012 Limousin ..... B29C 66/83423 53/547
9,718,569 B2 * 8/2017 Doll ..... B65B 9/06
10,336,489 B2 * 7/2019 Riccardi ..... B65B 43/267
10,654,599 B2 * 5/2020 Campbell ..... B65B 59/001
2006/0266005 A1 * 11/2006 Koke ..... B65B 31/024 53/510
2006/0277869 A1 * 12/2006 Drolet ..... B65B 43/34 53/455
2008/0229715 A1 * 9/2008 Schmidt ..... A61B 18/20 53/450

FOREIGN PATENT DOCUMENTS

CN 208593556 U 3/2019
KR 101809093 B1 1/2018

* cited by examiner

ITEM PACKAGING MACHINE WITH LONGITUDINAL AND LATERAL PACKAGE SIZING

CROSS-REFERENCE TO RELATED APPLICATIONS

This application claims the benefit of U.S. Provisional Patent Application No. 63/563,440 filed Mar. 10, 2024, the disclosure of which is hereby incorporated herein in its entirety by reference.

BACKGROUND OF THE INVENTION

Field of the Invention

This invention relates generally to packaging machines, and more specifically to an assembly and method for right-sized packaging of orders.

Background

Right-sized or customized packaging of orders in order fulfillment operations provides various benefits. Right-sized packaging minimizes costs associated with excess material and costs associated with shipping. Right-sized packaging maximizes protection of an order due to minimizing an ability of the order to move within the packaging. Although various solutions exist for packaging orders in order fulfillment operations, right-sized packaging in order fulfillment operations may be costly due to a number of components needed and an ability to flexibly package different sizes of orders.

SUMMARY

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

The embodiments described herein relate to a width trim module for an item packaging machine. The width trim module is configured to cut and seal packaging material including an upper layer and lower layer extending above and below an order, respectively, to form a package enveloping the order with the package including at least one closed side of packaging material opposite an unsealed side of packaging material. The width trim module includes a conveyor having a conveyor run, wherein the package is advanced onto the conveyor run between a first side and a second side thereof. A gripper assembly includes gripping members configured to selectively engage the upper layer and lower layer of the packaging material along the unsealed side of the package. The gripping members are moveable downward relative to the conveyor run to pull the package engaged by the gripping members laterally relative to the conveyor run toward the second side thereof. A sealing assembly is positioned between the conveyor and the gripper assembly. The sealing assembly is configured to seal the upper layer and lower layer of packaging material together to form a longitudinal seal along the unsealed side of the package after the package has been pulled toward the second side of the conveyor run and to cut away a portion of each of the upper layer and lower layer of the packaging material extending on a side of the longitudinal seal opposite the order in the package.

In an embodiment, the gripping members include a jaw pivotably mounted to a base, and the jaw is pivotable toward the base to engage and secure the unsealed side of the package between the jaw and the base.

In an embodiment, the gripper assembly is rotatable about an axis to move the gripping members downward to pull the package across the conveyor. In an embodiment, the gripper assembly is mounted on a shaft driven by a rotary drive unit.

In an embodiment, the gripper assembly is mounted on an elevator such that a position of the gripping members is vertically adjustable relative to the conveyor run.

In an embodiment, the sealing assembly includes an anvil member and a blade member, each extending parallel to the conveyor run, and the unsealed side of the package extending therebetween when the gripping members are in engagement with and have drawn the unsealed side of the package toward the second side of the conveyor run. In an embodiment, the anvil member and the blade member are vertically adjustable relative to the conveyor run. In an embodiment, the blade member is selectively heated.

The embodiments described herein relate to an order packaging machine configured to form a package enveloping an order from a roll of packaging material having a center fold. The order packaging machine includes an induction conveyor that advances each order into the order packaging machine. A height sizing conveyor advances each order to an order enveloping assembly including an upper triangle or first bracket that adjustably positions an upper layer of packaging material over the order and a lower triangle or second bracket that positions a lower layer of packaging material under the order, wherein the upper layer and lower layer of the packaging material at the height sizing conveyor together form a package with an unsealed leading edge, an unsealed trailing edge, and an unsealed side opposite a closed side of the package. A first or cross sealing assembly is positioned between the height sizing conveyor and a package draw conveyor, wherein the upper layer and lower layer of packaging material of an immediately preceding package advanced past the first sealing assembly extends continuous with the upper layer and the lower layer of the packaging material of the package at the height sizing conveyor, respectively. The first sealing assembly is configured to cut the upper layer and lower layer of packaging material between the immediately preceding package and the package at the height sizing conveyor and seal the unsealed leading edge of the upper layer and lower layer of packaging material of the package at the height sizing conveyor together to form a sealed leading edge and simultaneously seal a trailing edge of the upper layer and lower layer of packaging material of the immediately preceding package together. A package draw member selectively engages the package at the height sizing conveyor and advances the package onto the package draw conveyor and past the first sealing assembly a longitudinal distance corresponding to a length dimension of the order. The package draw conveyor is operable to convey the package to a width trim module. The width trim module includes gripping members configured to selectively engage the upper layer and lower layer of the packaging material along the unsealed side of the package. The gripping members are advanceable downward relative to a conveyor run of the width trim module to pull the package engaged by the gripping members laterally relative to the conveyor run. A second or side sealing assembly is positioned between the conveyor run of the width trim module and the gripping members. The second sealing assembly is configured to seal the upper layer and lower layer of packaging material together to form a longitudinal seal along the unsealed side of the package after the package has been pulled relative to the conveyor run of the width trim module and to cut away a portion of each of the upper layer and lower layer of the packaging material extending on a side of the longitudinal seal opposite the order in the package.

In an embodiment, the gripping members pull the package laterally relative to the conveyor run corresponding to a distance based on a width dimension of the order.

In an embodiment, the gripping members include a jaw pivotably mounted to a base, and the jaw is pivotable toward the base to engage and secure the unsealed side opposite the closed side of the package between the jaw and the base.

In an embodiment, the gripping members are rotatable about an axis to move the gripping members downward to pull the package across the conveyor run. In an embodiment, the gripping members are mounted on a base mounted on a shaft driven by a rotary drive unit.

In an embodiment, the gripping members are mounted on a base mounted on an elevator such that a position of the gripping members is vertically adjustable relative to the conveyor run.

In an embodiment, the second sealing assembly includes an anvil and a blade each extending parallel to the conveyor run and the unsealed side of the package extends therebetween when the gripping members are in engagement with the unsealed side of the package. In an embodiment, the anvil and the blade are vertically adjustable relative to the conveyor run. In an embodiment, an order packaging machine further includes a heated sealing member adjacent the blade.

The embodiments described herein relate to a method of forming a package around an order in an order packing machine configured to use a packaging material having a center fold. The method includes determining a length dimension and a width dimension of the order. The method further includes advancing the order past an order enveloping assembly operable to advance an upper layer of packaging material over the order and a lower layer of packaging material under the order with the center fold of the packaging material extending across a first side of the order. Still further, the method includes cutting and sealing a leading edge of the upper layer and lower layer of packaging material to form a sealed leading edge of the package extending transverse to the first side of the order. The method further includes engaging the package proximate the sealed leading edge and advancing the package with the order enveloped therein onto a package draw conveyor a distance corresponding to the length dimension of the order. Still further, the method includes cutting and sealing a trailing edge of the upper layer and lower layer of packaging material to form a sealed trailing edge of the package extending transverse to the first side of the package. The method further includes advancing the package with the order enveloped therein onto a conveyor run of a width trim module such that the upper layer and lower layer of an unsealed side opposite the first side of the package are engageable by gripping members. Still further, the method includes selectively engaging the upper layer and the lower layer of the unsealed side of the package by the gripping members. Still further, the method includes moving the gripping members engaging the unsealed side of the package downward relative to the conveyor run to pull the package with the order enveloped therein laterally relative to the conveyor run to advance the order contained in the package proximate to a cutting and sealing assembly and based upon the width dimension of the order. Stiff further, the method includes advancing the cutting and sealing assembly into engagement with the upper layer and lower layer of the packaging material along the unsealed side of the package to form side seal after the package has been pulled laterally relative to the conveyor run and cutting away a portion of each of the upper layer and lower layer of the packaging material extending on a side of the side seal opposite the order enveloped in the package.

In an embodiment, the method further includes rotating the gripping members about an axis to move the gripping members downward to pull the upper layer and lower layer of packaging material laterally relative to the conveyor run.

In an embodiment, the method further includes moving the gripping members vertically downward via an elevator to pull the upper layer and lower layer of packaging material laterally relative to the conveyor run.

In an embodiment, the method further includes vertically adjusting a position of an anvil and a blade of the cutting and sealing assembly relative to the conveyor run to position the anvil at a height above the conveyor run which is approximately half a height dimension of the order.

BRIEF DESCRIPTION OF THE DRAWINGS

Embodiments of the invention are described in detail below with reference to the attached drawing figures.

Figure 1:
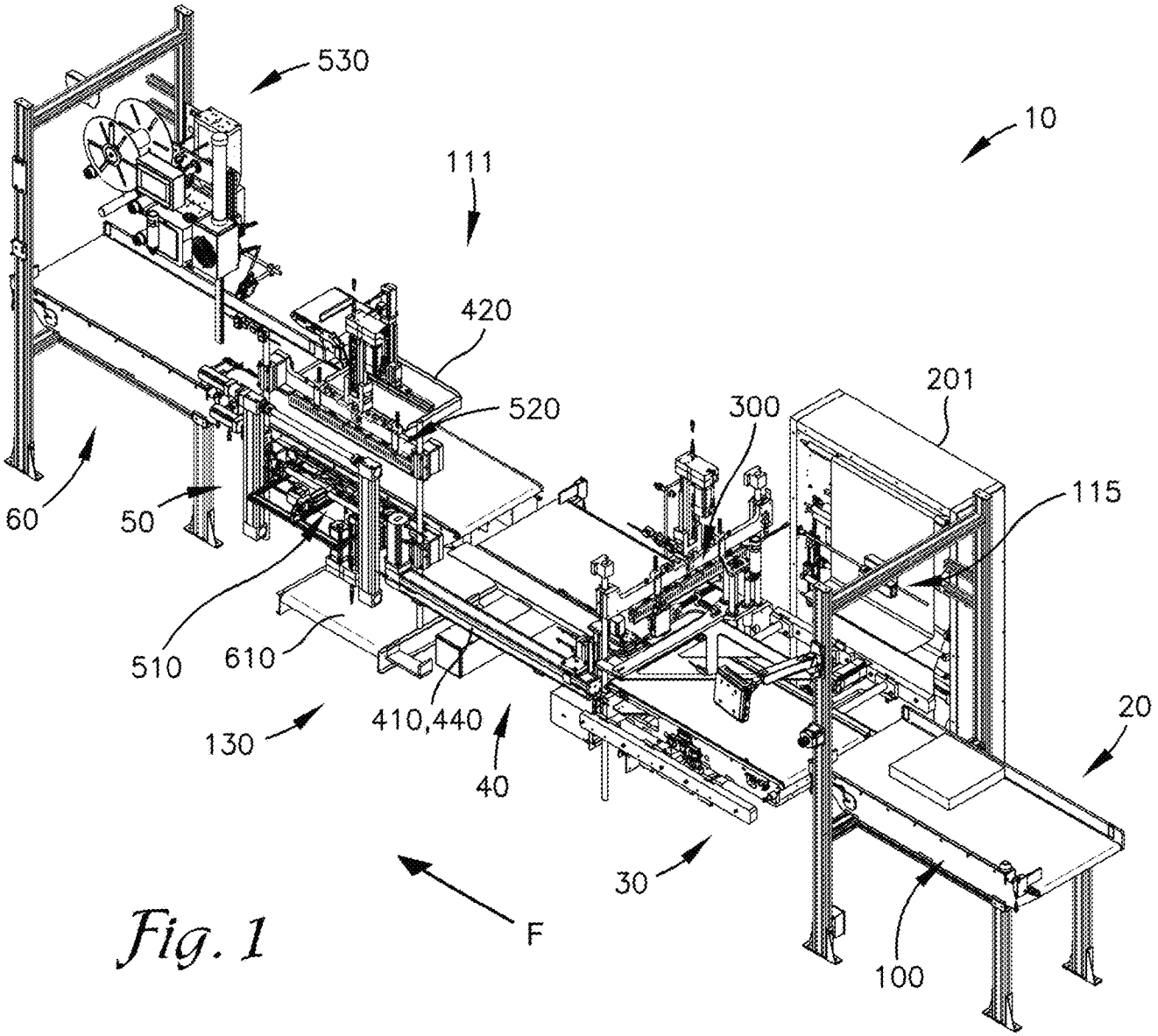
FIG. 1 is a front perspective view of an embodiment of an item packaging machine that is configured to package orders that include one or more items in right-sized packages. The item packaging machines includes an induction and dimensioning module, a height sizing module, a package draw module, a width trim module, and a label application module.

The drawing figures do not limit the invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENTS

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized, and changes can be made without departing from the scope of the invention. The following detailed description is, therefore, not to be taken in a limiting sense. The scope of the invention is defined only by the appended claims, along with the full scope of the equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the technology can include a variety of combinations and/or integrations of the embodiments described herein.

Figure 15A:
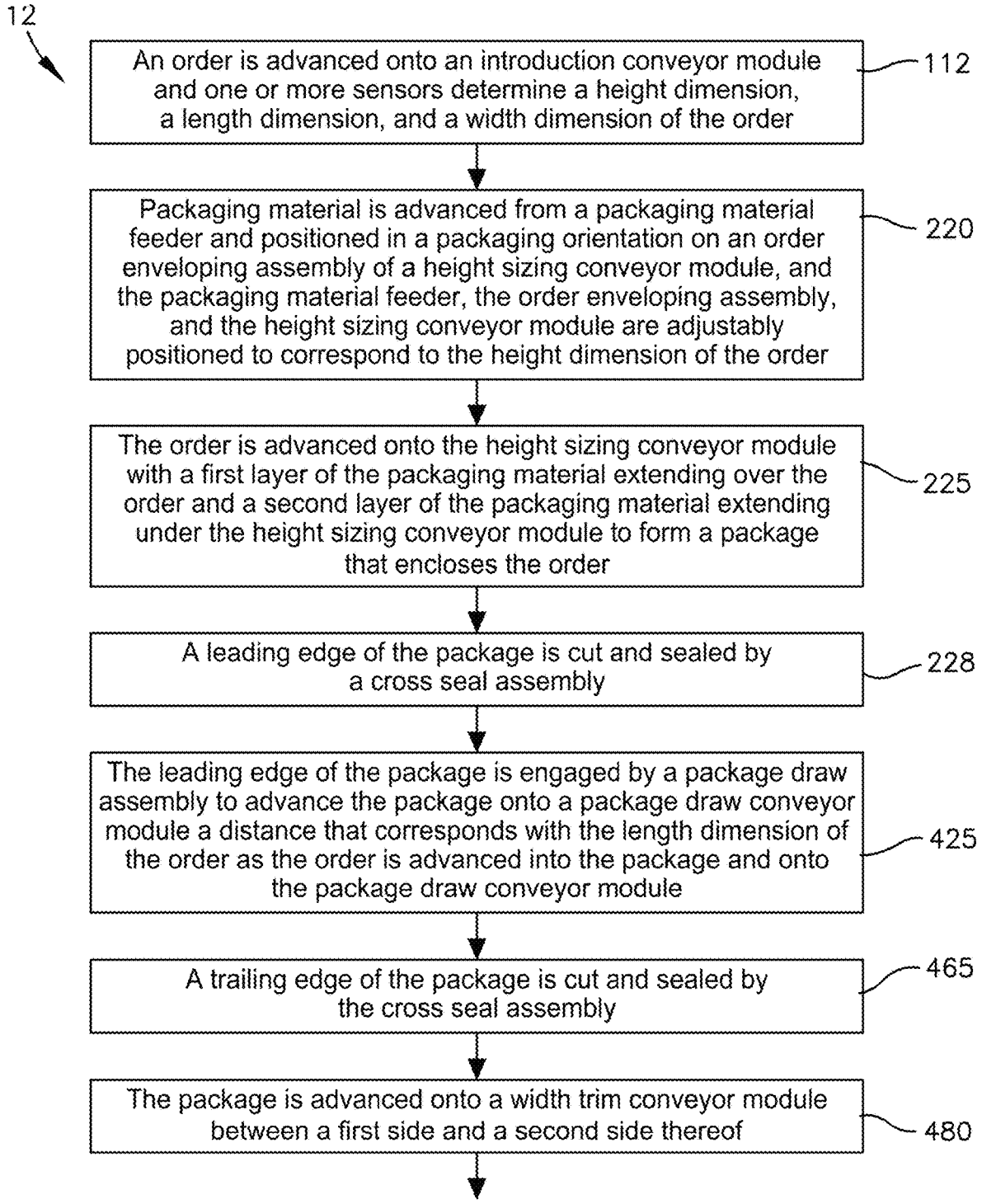
FIGS. 15*a* and 15*b* are flow diagrams of an embodiment of an item packaging machine process for the item packing machine shown in FIG. 1.
Figure 15B:
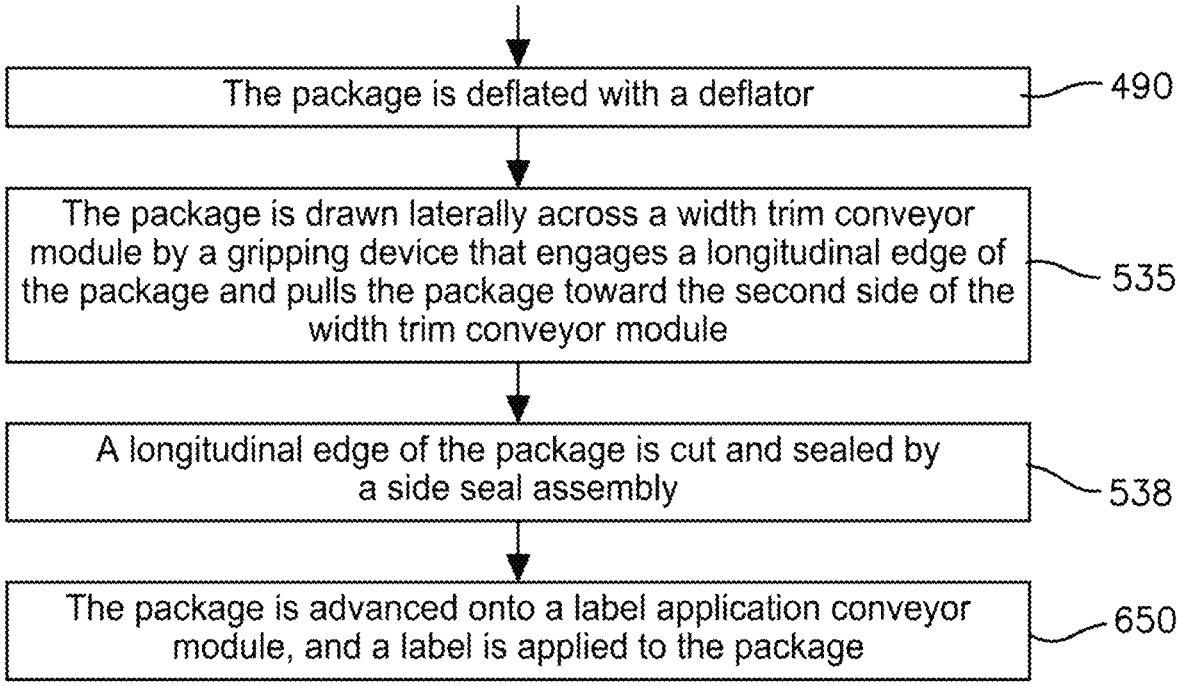

An embodiment of an item packaging machine 10 described herein is shown in FIG. 1 and may be part of an order fulfillment system that is used for customized or right-sized packaging of orders having a variety of dimensions. In FIGS. 15*a* and 15*b*, a process 12 of the item packaging machine 10 described herein is shown and described in a flow chart. FIG. 1 is a front perspective view of the item packaging machine 10 that is configured to package orders that include one or more items. Each order is delivered to the item packaging machine 10 and is advanced therethrough for packaging in a center folded, plastic-type material 15, such as a polyethylene film, polyolefin, polypropylene or another foreseeable material, that envelopes the order. The item packaging machine 10 is configured to form the right-sized packaging that corresponds to dimensions of the order. As used herein, the term corresponds to generally refers to packaging which is sized similar to the size of the order in width, length and height to minimize or reduce the amount of packaging material needed to form the package. An arrow labeled F in FIG. 1 denotes a direction of conveyance or flow of orders or products from an upstream position toward a downstream position in the item packaging machine 10.

Figure 2:
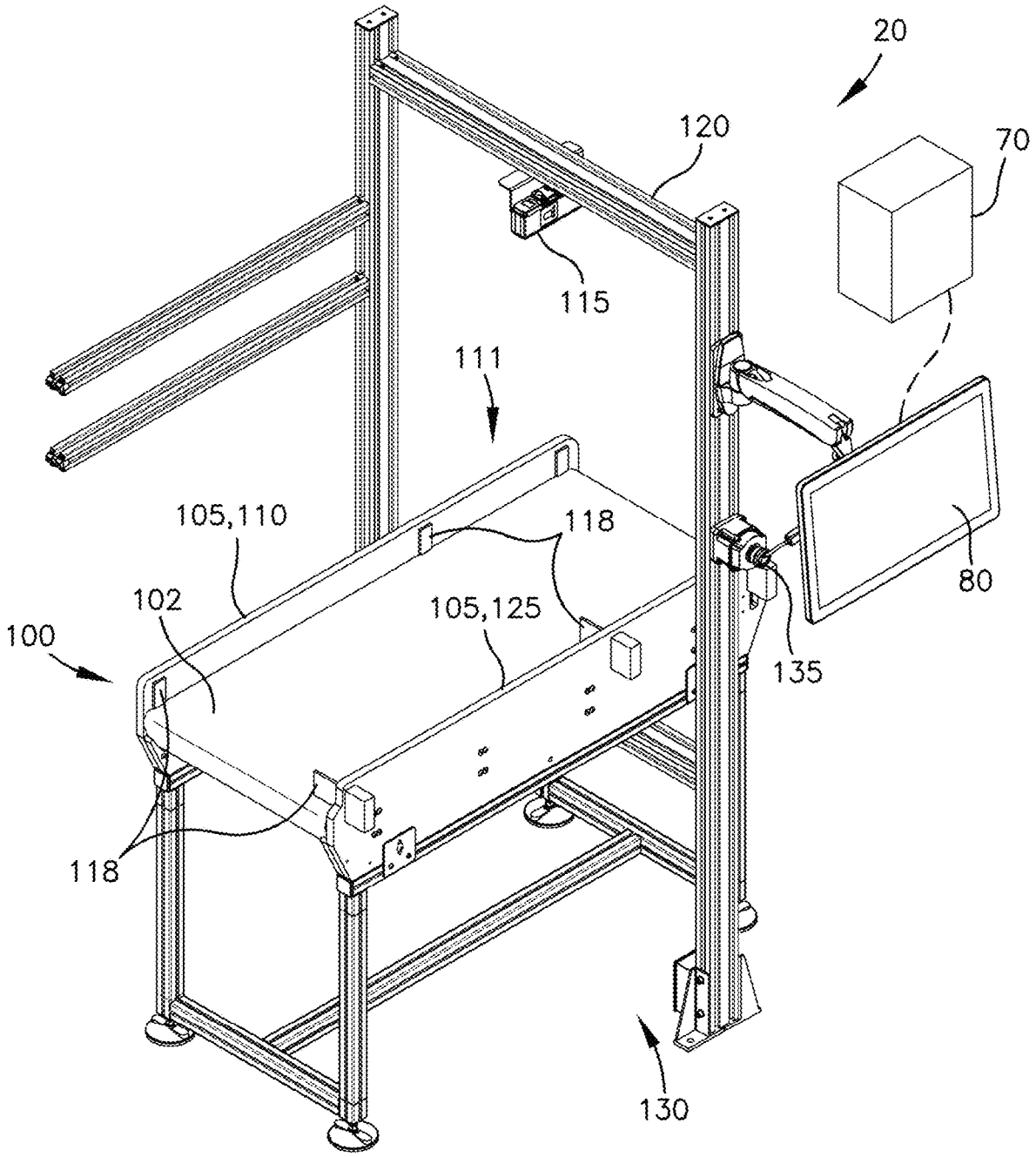
FIG. 2 is a front perspective view of an embodiment of the induction and dimensioning module shown in FIG. 1.

The item packaging machine 10 shown in an embodiment in FIG. 1 comprises a plurality of modules, including an induction and dimensioning module 20, a height sizing module 30, a package draw module 40, a width trim module 50, and a label application module 60. In the induction and dimensioning module 20, the order is introduced into the item packaging machine 10 and dimensions of the order are determined. The item then advances to the height sizing module 30 that is configured to advance the packaging material 15 around the order to envelope the order dependent on a height of the order. The package draw module 40 is configured to advance and seal the packaging material 15 around first and second ends of the order dependent on a length of the order. The width trim module 50 is configured to seal the packaging material 15 along a third side of the order opposite a closed end having a fold in the packaging material and dependent on a width of the order. Finally, the label application module 60 is configured to apply a label to the right-sized package containing the order sealed therein. It is foreseeable that one or more of the modules may be utilized for packaging an order in an order fulfillment system. Each of the plurality of modules includes a conveyor driven by a motorized drive and is communicatively coupled to a controller or processing system 70 (see FIG. 2) that is configured to control the item packaging machine 10. In an embodiment, each of the modules 20, 30, 40, 50 and 60 is independently controllable by the processing system 70. The processing system 70 may also be configured to track an order through the item packaging machine 10 and to coordinate application of item and/or customer information to the package in the label application module 60. In an embodiment, the processing system 70 is communicatively coupled to a processing system that controls the order fulfillment system FIG. 2 is a front perspective view of the introduction module or induction and dimensioning module 20 that includes an infeed conveyor 100 having a conveyor run 102. The infeed conveyor 100 includes at least one wall 105 that is positioned along one or both sides of the infeed conveyor 100. In an embodiment, the at least one wall 105 includes a guide wall or rear wall 110 that extends upward along a rear side 111 of the infeed conveyor 100 or of the item packaging machine 10 and is configured to direct or control advancement of orders on the conveyor run 102 in alignment with and adjacent to the guide wall 110.

In an induction and dimensioning step 112 of the item packaging machine 10, the order is introduced or advanced onto the conveyor run 102 adjacent to or abutting the guide wall 110. The order may be introduced onto the conveyor run 102 via an adjacent previous conveyor or by other means known in the art, such as by a user or robotic machine. The singulated order is advanced on the conveyor run 102 in alignment with and adjacent to the guide wall 110 and one or more sensors 115 and/or 118 determine one or more dimensions of the order. In an embodiment, the infeed conveyor 100 is a singulating conveyor that singulates and aligns the orders introduced thereon prior to dimensioning the order.

The one or more sensors 115 and/or 118 are positioned relative to the infeed conveyor 100 for determining a height, a width, and a length of the order as the order advances along the conveyor run 102. In an embodiment, the one or more sensors 115 include a three-dimensional scanning laser that captures at least a height and a width of the order, and the one or more sensors 115 are secured to a frame 120 that extends over the conveyor run 102 of the infeed conveyor 100. In an embodiment, the one or more sensors 118 are secured to the at least one wall 105 and used to determine a length of the order, and each of the one or more sensors 118 includes a transmitter and receiver that are secured to a sensor wall or front wall 125 that extends upward along a front side 130 of the infeed conveyor 100 or of the item packaging machine 10 and to the guide wall 110, respectively. In an embodiment shown in FIG. 2, the one or more sensors 118 are positioned a fixed distance apart along the conveyor run, and the length of the order is calculatable based upon an elapsed time detected by the sensors 118 of the order advancing on the conveyor run 102.

The dimensions of the order are utilized by the item packaging machine 10 to form a right-sized package around each order simultaneously with the order advancing through the item packaging machine 10. The one or more sensors 115 and 118 are communicatively coupled to the processing system 70, and the processing system 70 communicates the height, length, and width dimension of the order to the height sizing module 30, the package draw module 40, and the width trim module 50, respectively. In an embodiment, each of the height sizing module 30, package draw module 40, and width trim module 50 may have functions dependent upon one or more of the dimensions of the order.

In an embodiment, a monitor 80 for monitoring the item packaging machine 10 and a stop shutdown procedure switch or an emergency stop switch 135 are communicatively coupled to the processing system 70 for controlling the item packaging machine 10 and positioned adjacent the induction and dimensioning module 20. The monitor 80 and the switch 135 are secured on the frame 120 adjacent an entry of the item packaging machine 10 to enable a user to control the item packaging machine 10 and advancement of orders thereon and manage and troubleshoot issues such as jamming, while observing the item packaging machine 10 and any orders advancing thereon.

Figure 3:
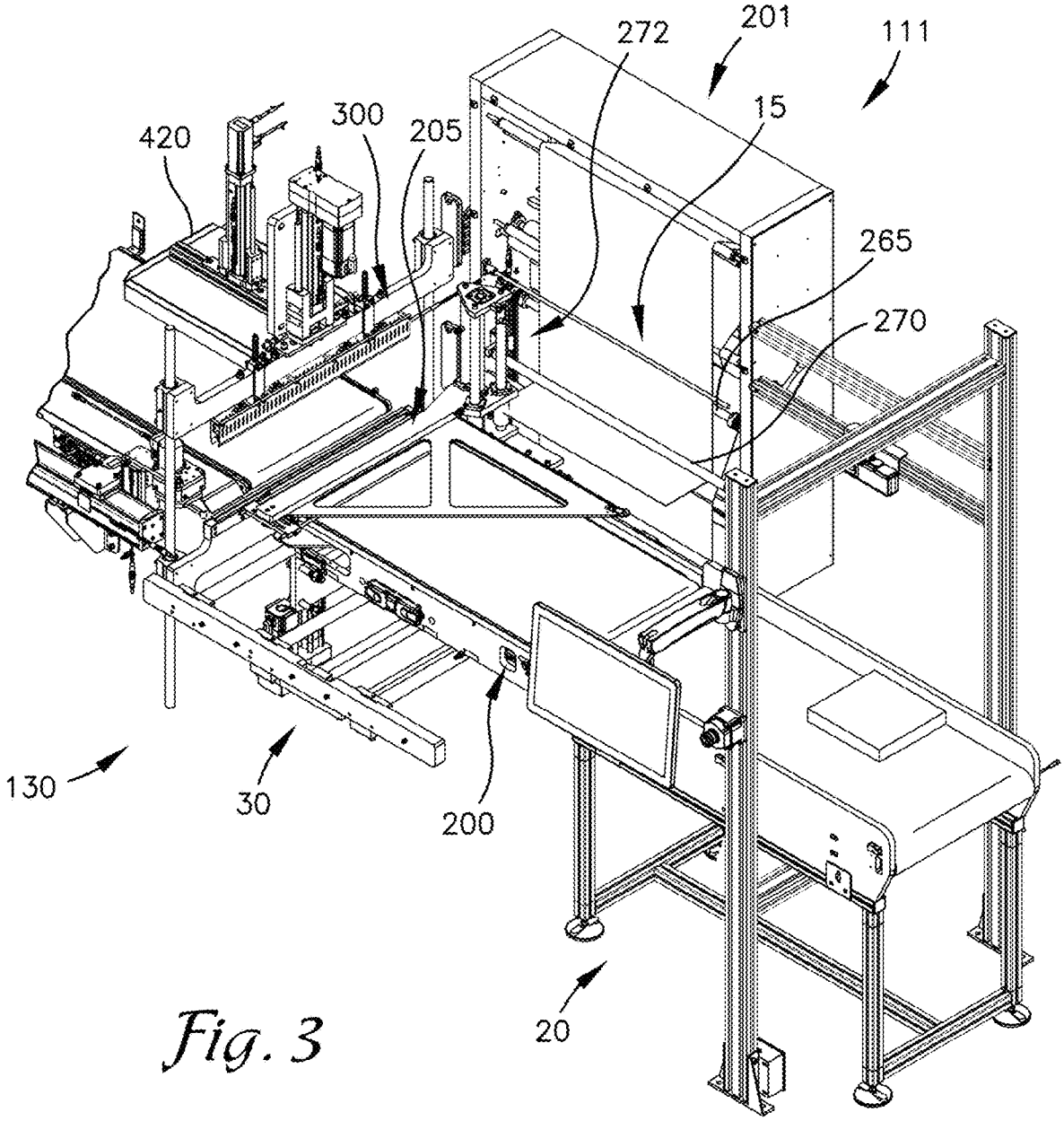
FIG. 3 is a front perspective view of an embodiment of the induction and dimensioning module and the height sizing module that includes a packaging material feeder, as shown in FIG. 1, with packaging material removed from over the height sizing module to show the components thereof.
Figure 4:
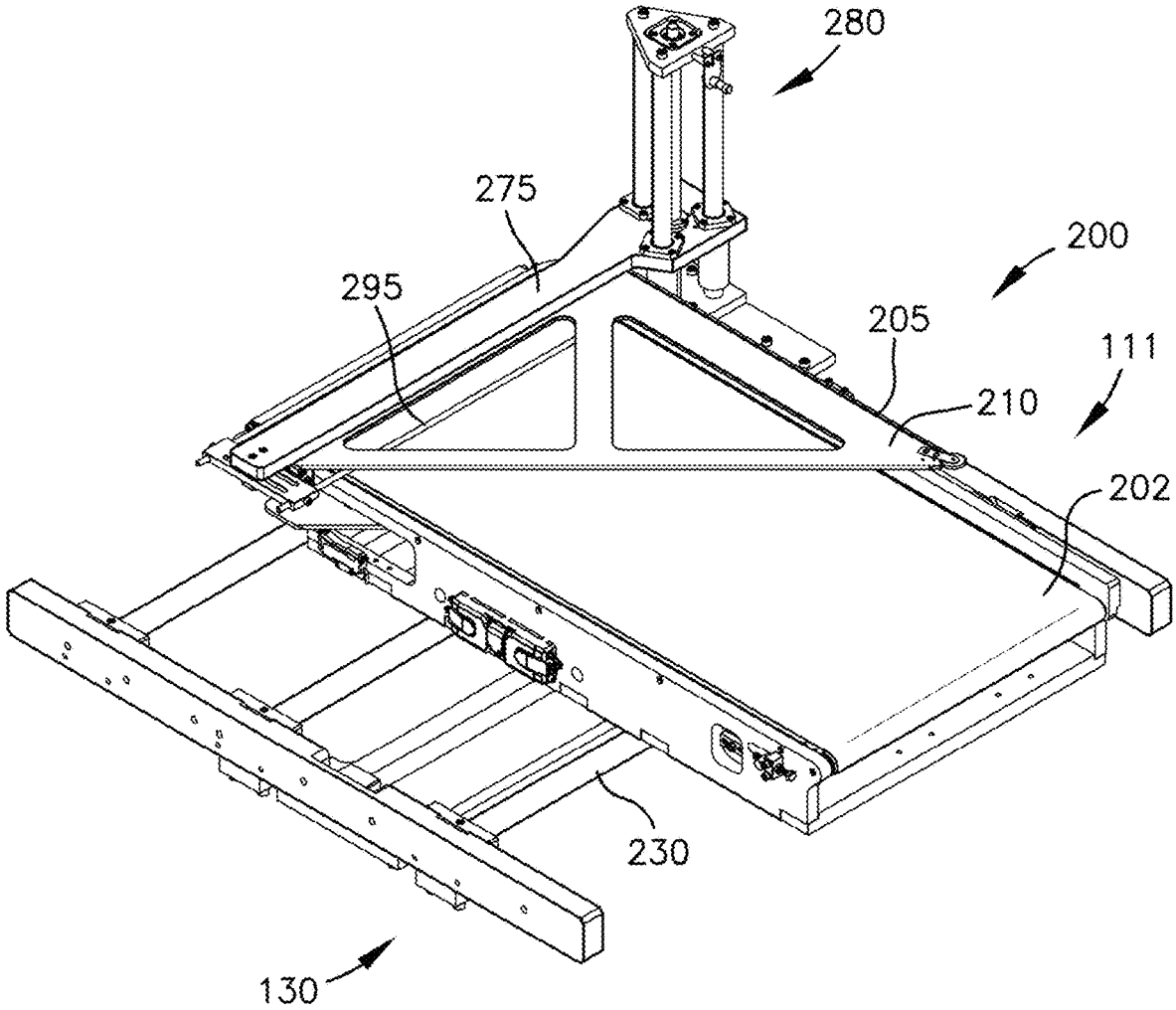
FIG. 4 is a front perspective view of an embodiment of a height sizing module conveyor and a film folding assembly of the height sizing module shown in FIG. 1.
Figure 5:
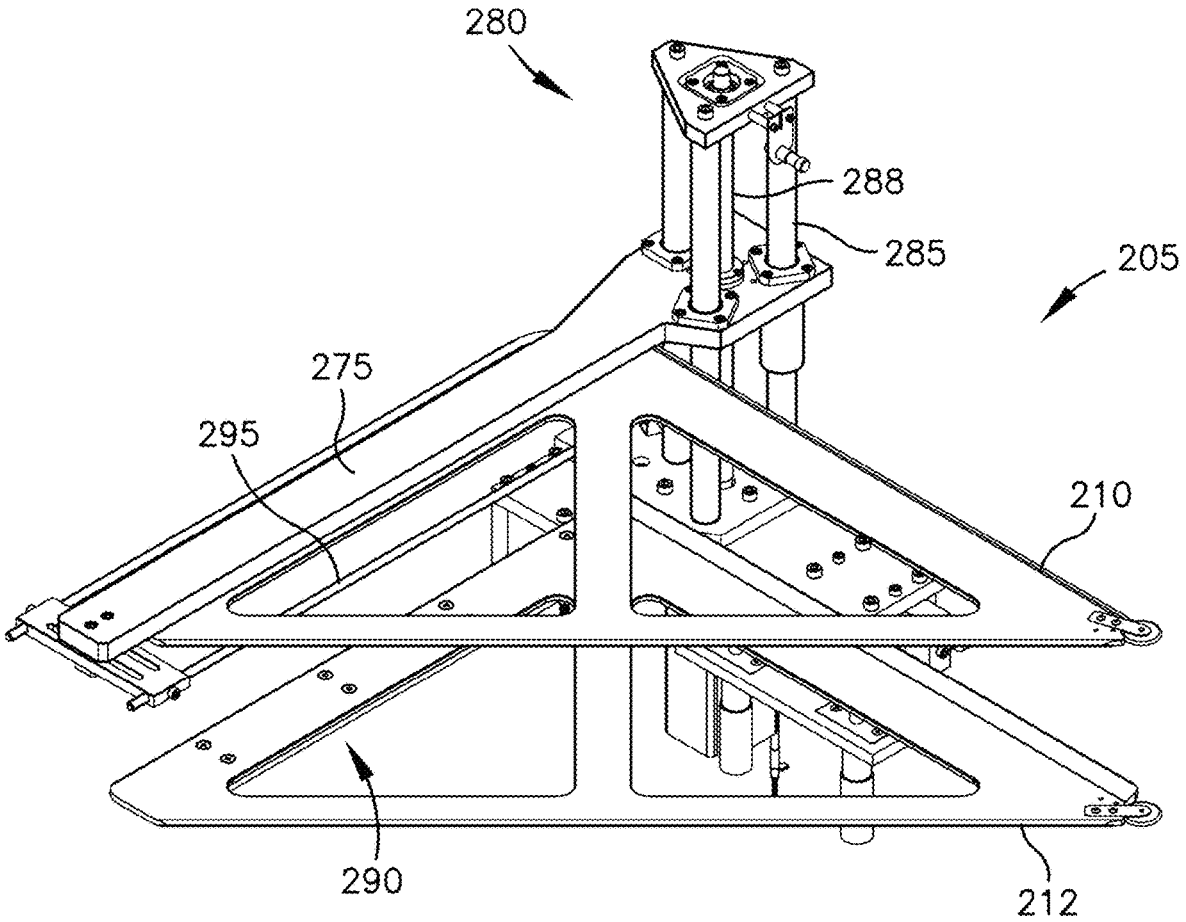
FIG. 5 is a perspective view of an embodiment of the film folding assembly of the height sizing module shown in FIG. 1.

FIG. 3 shows a front perspective view of the induction and dimensioning module 20 and the height sizing module 30 that includes a height sizing module conveyor 200 and a film or packaging material feeder 201. In FIG. 3, the packaging material 15 is shown on the packaging material feeder 201, but the packaging material 15 is removed from extending over the height sizing module conveyor 200 of the height sizing module 30 to show the components thereof. FIG. 4 shows a front perspective view of the height sizing module conveyor 200 having a height sizing module conveyor run 202 with a film folding assembly 205 adjustably secured therearound to support the packaging material 15 relative to the height sizing module conveyor run 202. FIG. 5 shows a perspective view of the film folding assembly 205.

In an embodiment shown in FIG. 3, the packaging material feeder 201 is positioned adjacent to the height sizing module conveyor 200, which includes the film folding assembly 205, and the packaging material 15 is advanced from the packaging material feeder 201 to engage an upper triangular bracket 210 and a lower triangular bracket 212 of the film folding assembly 205, which are shown in FIG. 5. The film folding assembly 205 is known in the art and may also be referred to as an order enveloping assembly. During a packaging material feeding step 220 in the item packaging machine 10, the packaging material 15 is advanced from the packaging material feeder 201 and positioned in a packaging orientation on the film folding assembly 205 such that a center fold of the packaging material 15 extends adjacent the rear side 111 of the height sizing module 30. The packaging material feeder 201, the film folding assembly 205, and the height sizing module conveyor 200 are adjustably positionable to correspond to the height of the order, as described herein. In a height sizing step 225 of the item packaging machine 10, the order is advanced onto the height sizing module conveyor run 202, and the packaging material 15 is adjustably positioned relative to a height of the order to enclose the order and minimize excess packaging material 15 therearound. Thereafter, in a first cutting and sealing step 228 of the item packaging machine 10, a leading or downstream edge of a package of the order on the height sizing module conveyor run 202 is cut and sealed separating the package from a trailing or upstream edge of a package on the package draw module 40.

FIG. 4 shows an embodiment of the height sizing module conveyor 200 that is laterally adjustable relative to a position of the infeed conveyor 100. The lateral position of the height sizing module conveyor 200 depends on the height of the order that is communicated from the processing system 70. The height sizing module conveyor 200 includes a plurality of guides or slides 230 to which the height sizing module conveyor 200 is slidably secured and may include a drive (not shown) that enables the height sizing module conveyor 200 to move laterally to position the order such that the center fold of the packaging material 15 is approximately centered relative to the height of the order when the order is advanced onto the height sizing module conveyor run 202 between the upper triangular bracket 210 and the lower triangular bracket 212. For example, the height sizing module conveyor 200 moves laterally toward the rear side 111 of the height sizing module 30 a greater distance for a shorter item to position the shorter item closer to the rear side 111 of the height sizing module conveyor 200 than a taller item. In an embodiment, the height sizing module conveyor 200 is communicatively coupled to the processing system 70 to automatically move the height sizing module conveyor 200 laterally relative to the height of the order. In an embodiment, the height sizing module conveyor 200 is manually adjustable laterally. The height sizing step 225 may further include adjustably moving the height sizing module conveyor 200 laterally to position the order relative to the center fold of the packaging material 15.

The packaging material feeder 201, shown in FIG. 3, rotatably supports a center folded roll of packaging material 15 that is rotatably secured on a support, such as a cradle and/or a roller (not shown), and the roll is positioned such that the center fold side of the packaging material 15 is positioned toward an upstream end of the item packaging machine 10. The packaging material 15 extends upward from the cylindrical roll and around a plurality of rollers to maintain a tension on the packaging material 15 as it is fed to the film folding assembly 205. The plurality of rollers may include one or more of: one or more idler rollers, one or more pinch rollers having a plurality of clamps that cooperate to maintain a consistent feed of the packaging material 15 thereacross, one or more dancer rollers adjustably moveable to correct for changes in the tension of the packaging material 15, and other roller devices. The plurality of rollers may be used in a variety of combinations to maintain the tension on the packaging material 15 and ensure a consistent feed of the packaging material 15 as it is fed to the film folding assembly 205 to form a package enveloping the orders. From a top of the packaging material feeder 201, the packaging material 15 extends downward along a front of the packaging material feeder 201 toward the height sizing module conveyor 200. A splitter bar 265 extends between a top or first layer and a bottom or second layer of the folded packaging material 15 to maintain a separation of the top layer and the bottom layer of the packaging material 15. The top layer and the bottom layer of the packaging material 15 extend behind a height adjustable bar 270 that is adjustably aligned with the upper triangular bracket 210 of the film folding assembly 205. The height adjustable bar 270 is secured to a guide of a height adjusting mechanism 272 that is vertically moveable in a track by a linear actuator (not shown) driven by a motor. In an embodiment, the actuator is coupled to the height adjusting mechanism 272 and is communicatively coupled to the processing system 70 to enable automated adjustment of a height or position of the height adjustable bar 270 relative to the height of the order such that the packaging material 15 extends directly from the packaging material feeder 201 to engage the film folding assembly 205 that is positioned relative to the order, while maintaining the tension of the packaging material 15. The height sizing step 225 may further include adjustably moving the height adjusting mechanism 272 vertically to position the height adjustable bar 270 relative to the height of the order.

FIG. 5 shows a perspective view of the film folding assembly 205 that includes the upper triangular bracket 210 that is vertically positionable to extend over the order advancing on the height sizing module conveyor run 202 of the height sizing module conveyor 200 and the lower triangular bracket 212 that extends under the height sizing module conveyor run 202 of the height sizing module conveyor 200. The upper triangular bracket 210 is secured to an upper bracket mount 275 that is adjustably mounted on a screw drive assembly 280 that includes a plurality of longitudinally extending guides 285 that are in engagement with the upper bracket mount 275. In an embodiment the guides 285 are shafts or rails that extend through apertures formed in the upper bracket mount 275 and direct the movement of the upper triangular bracket 210 vertically. A motor (not shown) drives an actuator or ball screw 288 such that the screw drive assembly 280 vertically adjusts the upper bracket mount 275 relative to the guides 285 to vertically adjust the upper triangular bracket 210 to accommodate a height of the order advancing on the height sizing module conveyor run 202 of the height sizing module conveyor 200 and to minimize packaging material 15. In an embodiment, the actuator coupled to the actuator or ball screw 288 is communicatively coupled to the processing system 70 to enable automated adjustment of a height or position of the upper bracket mount 275 such that the upper triangular bracket 210 is positioned relative to the height of the order and the packaging material 15 is supported by the upper triangular bracket 210 over the order. The lower triangular bracket 212 is secured to a lower bracket mount 290 that is secured under the height sizing module conveyor 200. The height sizing step 225 may further include adjustably moving the actuator or ball screw 288 to position the upper bracket mount 275 such that the upper triangular bracket 210 is positioned to support the packaging material 15 relative to the order.

The packaging material 15 with the center fold extends such that the top layer of the packaging material 15 extends between the upper triangular bracket 210 and a first bar or support frame 295 spaced between the upper triangular bracket 210 and the height sizing module conveyor run 202 to maintain the top layer of the packaging material 15 above the height sizing module conveyor run 202, and the bottom layer of the packaging material 15 extends between the height sizing module conveyor 200 and the lower triangular bracket 212. It is foreseeable that a second bar or support frame may extend under the height sizing module conveyor 200 and above the lower triangular bracket 212 to maintain the bottom layer of the packaging material 15 below the height sizing module conveyor run 202. In an embodiment, the packaging material 15 that extends from the height adjustable bar 270 is folded such that the top layer of the packaging material 15 extends over the upper triangular bracket 210 and is folded around the hypotenuse of the upper triangular bracket 210 to extend between the upper triangular bracket 210 and the bar or support frame 295, the bottom layer of the packaging material 15 extends under the lower triangular bracket 212 and is folded around the hypotenuse of the lower triangular bracket 212 to extend between the lower triangular bracket 212 and the height sizing module conveyor 200, and the center fold extends adjacent the rear side 111 of the item packaging machine 10. The ends of the top layer and the bottom layer of the packaging material 15 extend downstream therefrom.

The lateral extending sides of the package, that include the top layer and the bottom layer of the packaging material 15 that extend from the film folding assembly 205 and form the lateral leading and trailing edges of the package, are cut and sealed with a cross seal assembly 300 positioned laterally relative to the height sizing module conveyor 200 and adjacent to and upstream of the film folding assembly 205. An embodiment of the cross seal assembly 300 shown in FIGS. 1 and 3 shows a position of the cross seal assembly 300 relative to and between the height sizing module 30 and the package draw module 40. The top layer and the bottom layer of packaging material 15 extend around and in enveloping relationship with an order positioned in the package draw module 40 and extend relative to the order positioned on the height sizing module conveyor run 202 as described herein. The cross seal assembly 300 cuts and seals laterally across the packaging material 15, simultaneously forming the leading edge of the package for the order on the height sizing module conveyor run 202 and the trailing edge of the package in the package draw module 40, such that the package in the package draw module 40 is severed from the packaging material 15 extending from the height sizing module 30 forming the package being formed therein.

Figure 6:
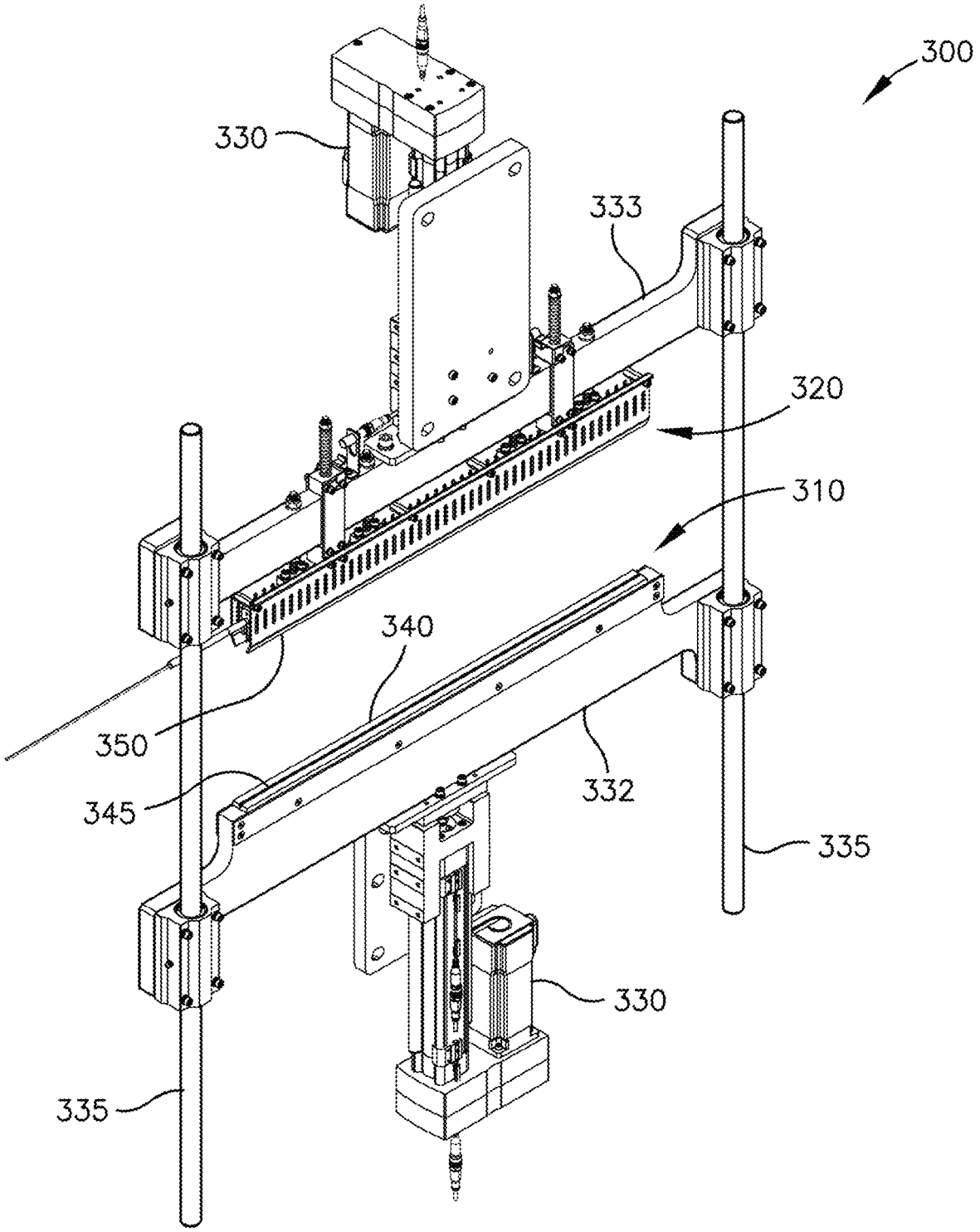
FIG. 6 is a perspective view of an embodiment of a cross seal assembly of the height sizing module shown in FIG. 1.

FIG. 6 shows a perspective view of the cross seal assembly 300, including an anvil member 310 positioned parallel to and in planar alignment with a blade member 320. The anvil member 310 and the blade member 320 are each coupled to respective drive mechanisms 330 that each include an actuator driven by a motor. A mount 332 of the anvil member 310 and a mount 333 of the blade member 320 are moveably secured on vertically extending guide members 335 extending on each side of the cross seal assembly 300. The mounts 332 and 333, in cooperation with the respective drive mechanisms 330, are configured such that the anvil member 310 and blade member 320 are positionable relative to the height sizing module conveyor 200 and/or the package draw conveyor 400. The anvil member 310 and blade member 320 are independently vertically drivable to seal and cut packages advancing through the item packaging machine 10. In an embodiment, the anvil member 310 is positioned just below the height sizing module conveyor run 202, and the anvil member 310 is configured to move upward to engage the blade member 320 a distance equivalent to half a height of the order such that the leading edge of the package is cut and sealed an equal distance from a top and a bottom thereof.

The anvil member 310 is positioned relative to the height sizing module conveyor run 202 and/or the package draw conveyor run 402 and includes a seal bar 340 that has a channel 345 extending therein that is configured to cooperate with the blade member 320 to seal and cut the packaging material 15. In an embodiment, the anvil member 310 is positioned below the blade member 320, and an opening of the channel 345 is on top of the anvil member 310 or faces toward the blade member 320. The anvil member 310 may be vertically positioned based on the height of the order on the induction and dimensioning module 20 and/or the order on the height sizing module 30, the dimensions which are communicated from the processing system 70.

The blade member 320 is heated to seal and cut the packaging material 15 when the blade member 320 engages the anvil member 310 with the packaging material 15 extending therebetween. In an embodiment, the blade member 320 is positioned above the anvil member 310, and when the blade member 320 is lowered and/or the anvil member 310 is raised, a blade or bar 350 of the blade member 320 extends into the channel 345 of the anvil member 310 to cut and seal the packaging material 15 extending over the anvil member 310.

Figure 7:
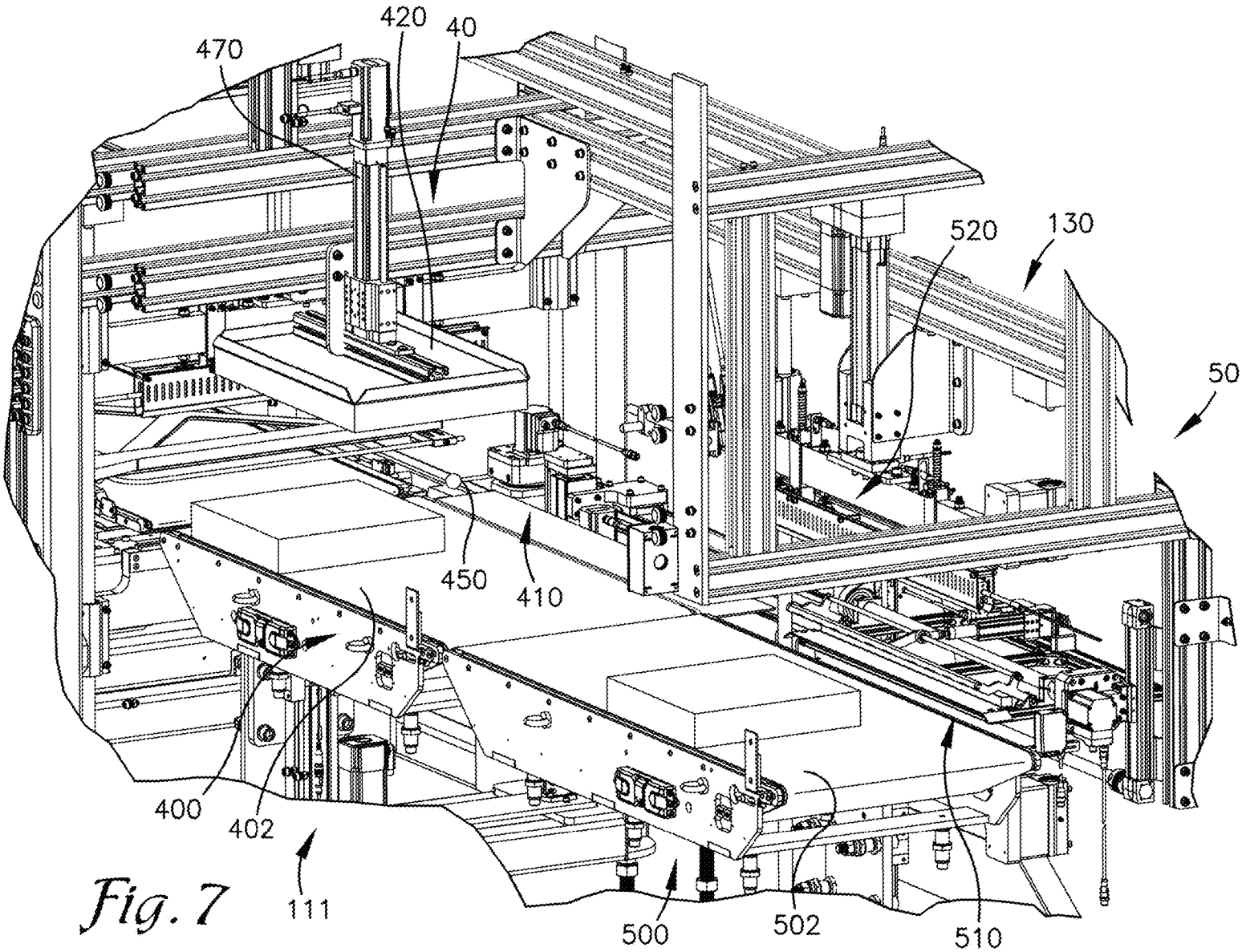
FIG. 7 is a rear perspective view of an embodiment of the package draw module and the width trim module shown in FIG. 1 from a downstream perspective of the item packaging machine and with the packaging material removed from the orders to clearly show the components.

FIG. 7 shows a rear perspective view of the package draw module 40 and the width trim module 50 from an upstream position on the item packaging machine 10, with the packaging material 15 removed from the orders on the item packaging machine 10 to clearly show the components of the item packaging machine 10. The package draw module 40 includes a package draw conveyor 400 that includes a package draw conveyor run 402 and a package draw assembly 410. A package formed from the packaging material 15 and sealed along a leading edge is advanced from the height sizing module conveyor run 202 to the package draw conveyor run 402, adjacent the rear side 111 thereof, concurrently with the respective order that advances from the height sizing module conveyor run 202 onto the bottom layer of the package on the package draw conveyor run 402, the bottom layer of the package drawing under the order and the top layer of the package drawing over the order to envelope the order. The order may engage the sealed leading edge of the package as it advances onto the package draw module 40. The package is advanced onto the package draw conveyor run 402 by the package draw assembly 410 that may be communicatively coupled to the processing system 70 that communicates at least a length of the order thereto. In an embodiment, the package draw assembly 410 pulls or draws the package on the draw conveyor run 402 a distance that corresponds to the length and a height component of the order and then pauses such that the cross seal assembly 300 cuts and seals the packaging material 15 to form the package having a trailing cut and sealed edge with the order positioned therein. The trailing edge of the package on the package draw module 40 corresponds to a leading edge of the package in the height sizing module 30 on which a seal on the leading edge is simultaneously formed. The edges of the packages are approximately adjacent to the respective sides of the orders. In a package draw step 425 of the item packaging machine 10, the leading edge of the package is engaged by the package draw assembly 410 that draws or advances the package onto the package draw conveyor run 402 a distance that corresponds with at least the length of the order as the order is advanced into the package on the package draw conveyor run 402.

In an embodiment shown in FIG. 7, the deflator 420 is positioned above the package draw conveyor run 402 of the package draw module 40. The deflator 420 is secured to a guide that is coupled to a deflator elevator 470 that includes an actuator driven by a motor. The deflator 420 is lowered to compress and deflate the package through an unsealed edge that is the edge adjacent the front side 130 of the item packaging machine 10. The deflator elevator 470 may be communicatively coupled to the processing system 70 such that the order is not over-compressed. Alternatively, the deflator 420 may be positioned above the width trim module 50 as described herein.

Figure 8:
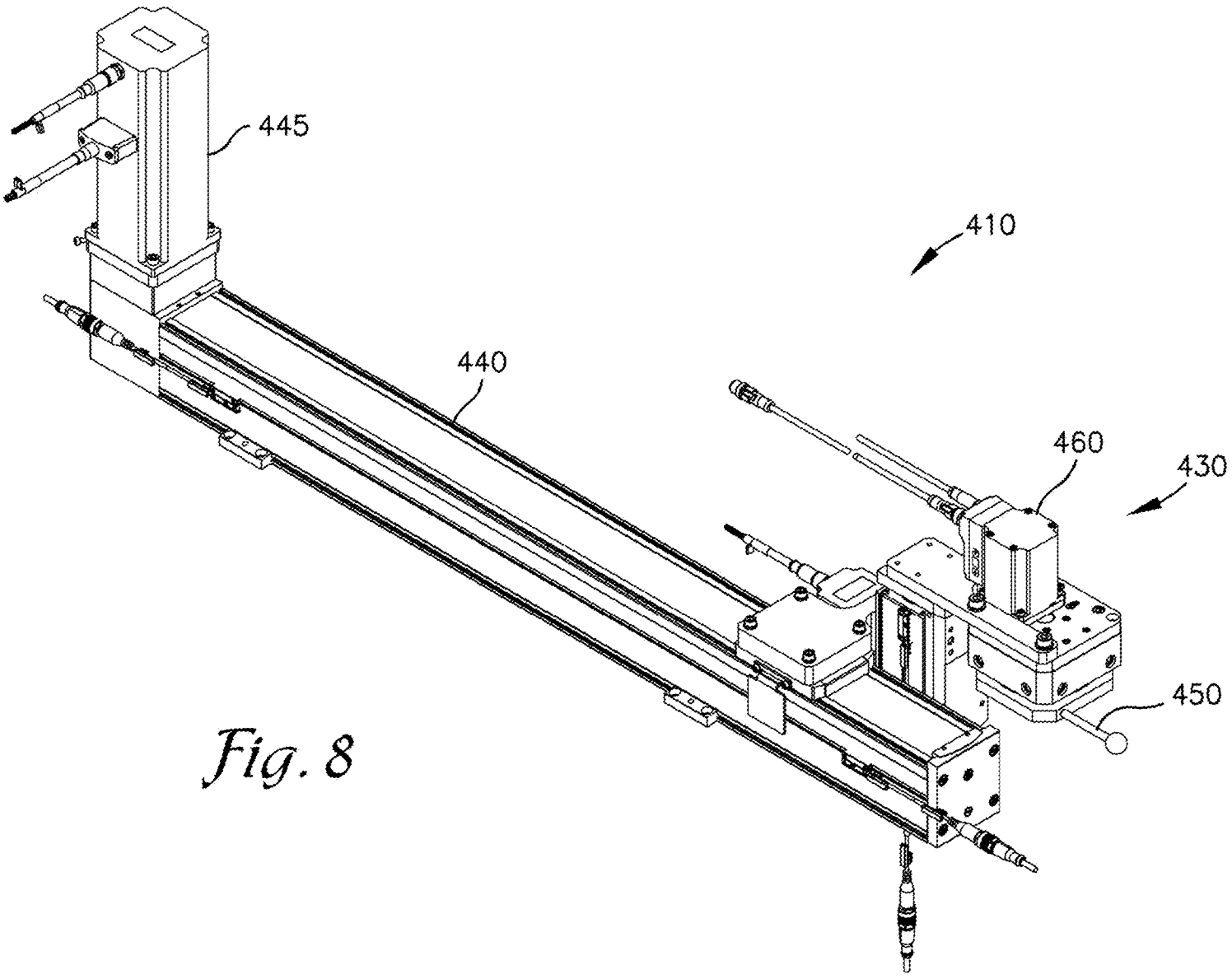
FIG. 8 is a perspective view of an embodiment of the package draw assembly that includes a gripper of the package draw module shown in FIG. 1.

FIG. 8 shows a perspective view of the package draw assembly 410 that includes a package draw gripper mechanism 430 moveably coupled to a guide or track 440 with the package draw gripper mechanism 430 driven along the track by a motor 445 and transmission mechanism (not show). The package draw assembly 410 is secured to the front side 130 of the package draw conveyor 400, and the motor 445 drives the package draw gripper mechanism 430 along the track 440 parallel to a direction of travel of the package draw conveyor run 402. The package draw gripper mechanism 430 includes a rod or gripper 450 that is rotatably coupled to a rotary drive 460 secured thereto and best shown in FIG. 8 extending upstream. The package draw gripper mechanism 430 moves from an upstream position proximate the cross seal assembly 300 to a downstream position of the package draw module 40, the downstream position corresponding to a length and a height component of the order. In the upstream position, the gripper 450 is rotatably positioned extending upstream and parallel to the direction of travel prior to the leading edge of the package for the order on the height sizing module conveyor run 202 being formed or sealed and cut. After the leading edge of the packaging material 15 is sealed and cut, the gripper 450 rotates approximately 90° as shown in FIG. 7, to extend laterally relative to the direction of travel to engage an inside of the package adjacent the sealed leading edge thereof. The gripper 450 is also vertically adjustable relative to a height of the order to engage the package so that the package does not tilt or move askew when the gripper 450 engages and advances the package. The package draw gripper mechanism 430, with the gripper 450 in engagement with the leading edge of the package, moves along the track 440 in the downstream direction in cooperation with the package draw conveyor 400 to move the package from the height sizing module 30 onto the package draw conveyor run 402 the distance that corresponds to packaging for the length of the order. In an embodiment, the distance that corresponds to packaging for the length of the order factors in the length and a height dimension of the order such that the leading and trailing edges of the packaging material 15 are sealed a distance equivalent to half a height of the order such that the trailing edge of the package is cut and sealed an equal distance from a top and a bottom thereof. When the package draw gripper mechanism 430 stops at the downstream position, the gripper 450 rotates to extend upstream and parallel to the package draw conveyor run 402, the package draw gripper mechanism 430 returns to its downstream position to engage the next package, and the cross seal assembly 300 engages the packaging material 15 to form the trailing edge of the package. Following the package draw step 425, a second cutting and sealing step 465 of the item packaging machine 10 comprises a trailing edge or upstream edge of a package of the order on the package draw conveyor 400 being cut and sealed, separating from and simultaneously sealing the leading edge of a package on the height sizing module 30.

FIG. 1 includes a front perspective view of the width trim module 50, and FIG. 7 includes a rear perspective view of the width trim module 50. In a width trim conveyor advancement step 480 of the item packaging machine 10, the package with the order therein is advanced from the rear side 111 of the package draw conveyor run 402 to the rear side 111 of the width trim module 50, or between the rear side 111 and the front side 130 thereof. In an embodiment shown in FIG. 1, width trim module 50 includes the deflator 420 positioned above the width trim module 50, and in a deflating step 490, the deflator 420 is moved vertically or lowered to engage the package having sealed leading and trailing edges such that excess air is expelled from the package through one or more vent holes that are pre-applied to the packaging material 15 with one or more punch tools (not shown) during the packaging material feeding step 220 at the packaging material feeder 201. The size and type of vent hole is selectively configurable by replacement of the one or more punch tools. The deflating step 490 may occur prior to or after sealing a final, unsealed longitudinal side of the package.

The width trim module 50 includes a width trim module conveyor 500 having a width trim conveyor run 502, a width trim gripper assembly 510 secured to the front side 130 of the width trim module 50, a side seal assembly 520 secured between the width trim gripper assembly 510 and the width trim module conveyor 500, and, in an embodiment, the deflator 420 positioned above the width trim module 50 to compress and deflate the package. Upon being advanced onto the width trim conveyor run 502 of the width trim module 50, the open side of the package, which is unsealed and uncut, extends over the width trim conveyor run 502 and towards the front side 130 of the item packaging machine 10 for engagement or grasping by the width trim gripper assembly 510.

In a width trim lateral advancement step 535 of the item packaging machine 10, a package is drawn laterally across the width trim conveyor run 502 by the width trim gripper assembly 510. It is foreseeable that one or more of components or mechanisms may be utilized in determining how far to laterally advance the package and/or where to stop advancing the package, including, for example, a stop or wall projecting upward above the width trim conveyor run 502, the anvil member 310 of the side seal assembly 520 positioned or adjusted to form a stop, one or more sensors that sense a position of the package, a determined or calculated result dependent on the width of the order that is communicated from the processing system 70 and has the effect to advance the package a distance from proximate the rear side 111 to the front side 130 of the width trim conveyor run 502, or a combination of the components and/or mechanisms thereof. In a third cutting and sealing step 538 of the item packaging machine 10, the side seal assembly 520 cuts and seals a longitudinal unsealed or open side of the package.

Figure 9:
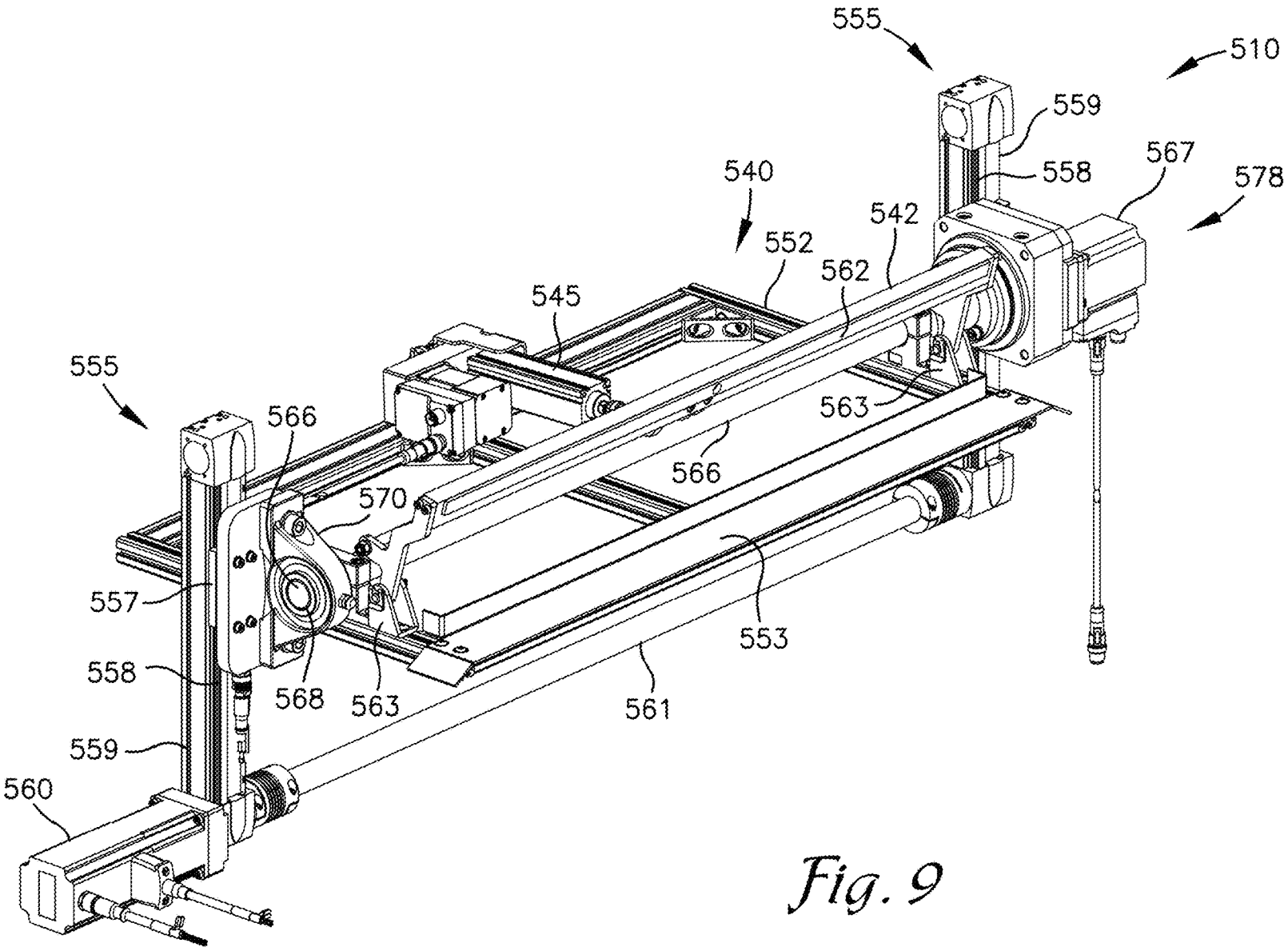
FIG. 9 is a perspective view of an embodiment of the width trim gripper assembly of the width trim module shown in FIG. 1.
Figure 10:
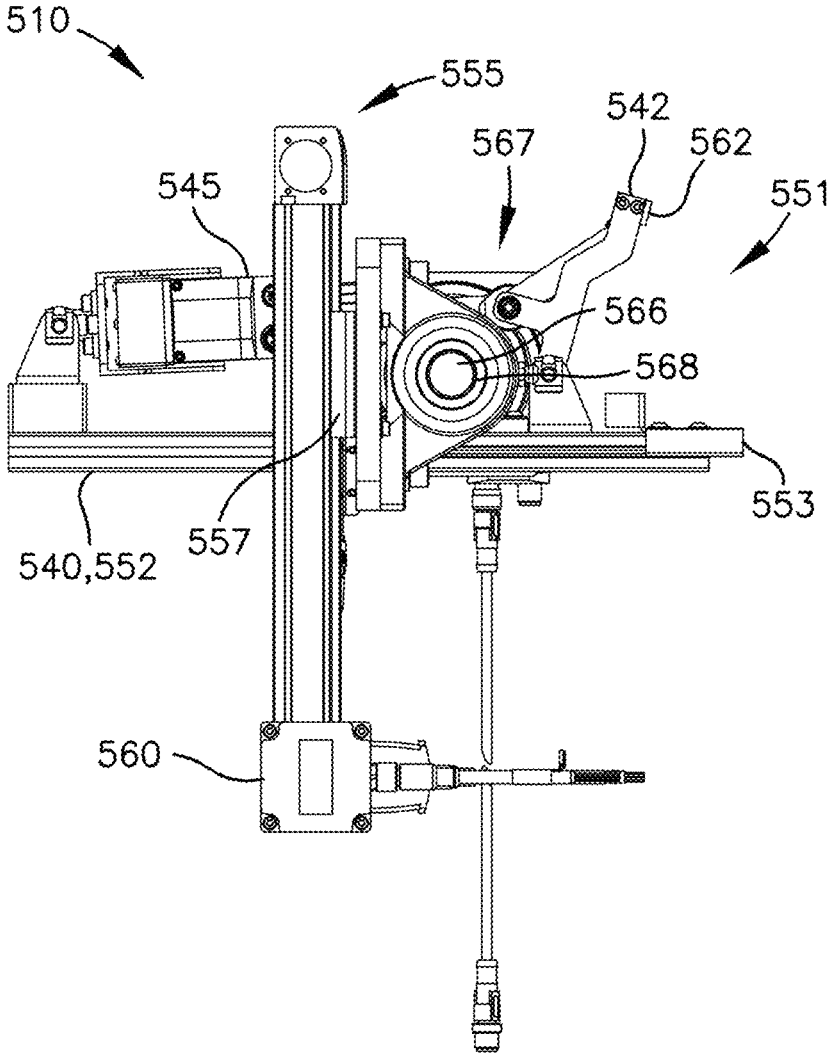
FIG. 10 is an elevation view of an embodiment of the width trim gripper assembly shown in FIG. 9 with a jaw member of the gripping device in an open position.
Figure 11:
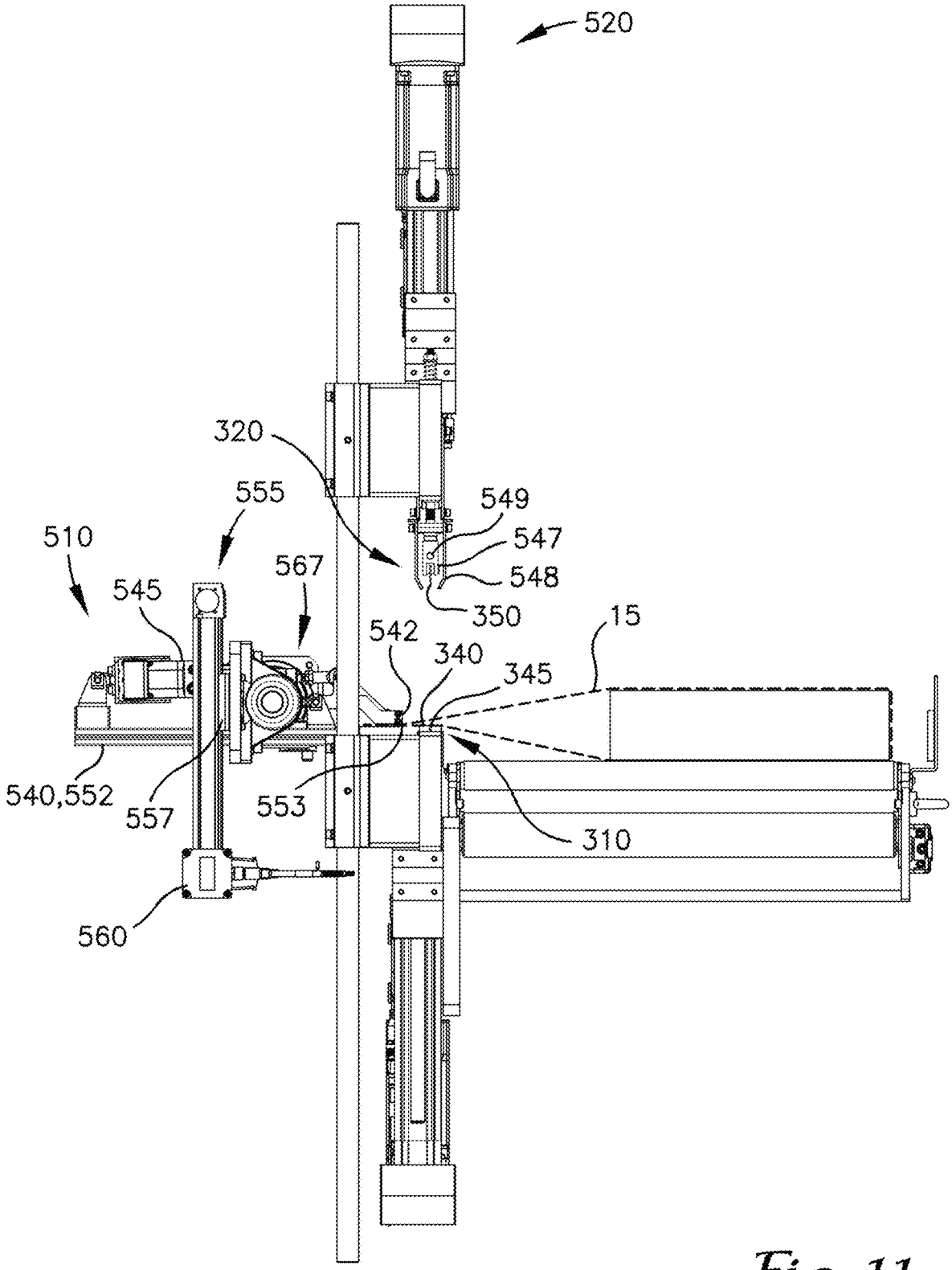
FIG. 11 is an elevation view of an embodiment of the width trim gripper assembly, a side seal assembly, and a width trim module conveyor of the width trim module shown in FIG. 1, with the gripping device gripping an unsealed and uncut side of a package supported on a first side of the width trim module conveyor.
Figure 12:
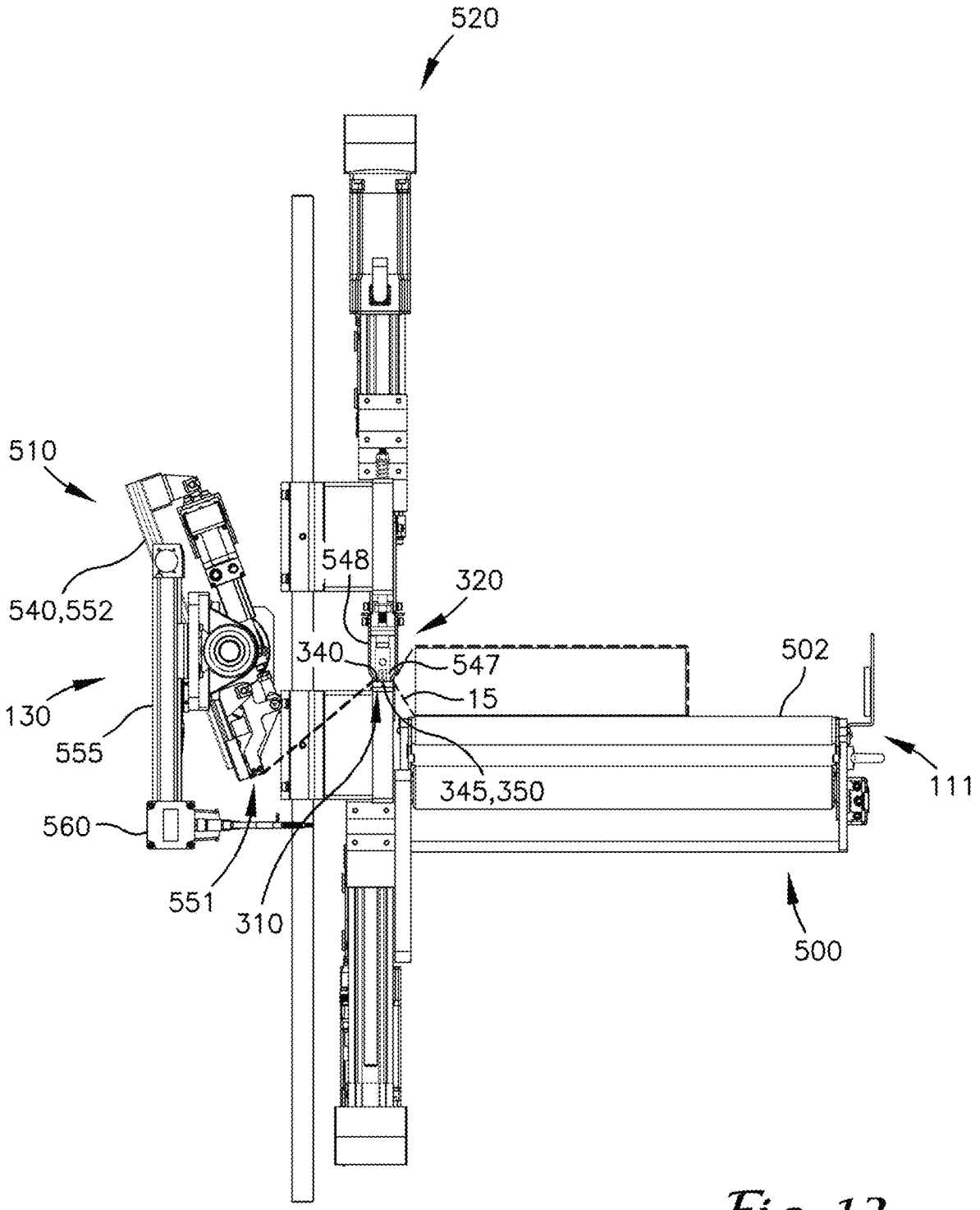
FIG. 12 is an elevation view of an embodiment of the width trim gripper assembly, the side seal assembly, and the width trim module conveyor of the width trim module shown in FIG. 1, with the gripping device rotated less than 90° to lower the gripping device gripping the package, the side seal assembly engaging the package to cut and seal the package, and the package laterally advanced onto a second side of the width trim module conveyor.
Figure 13:
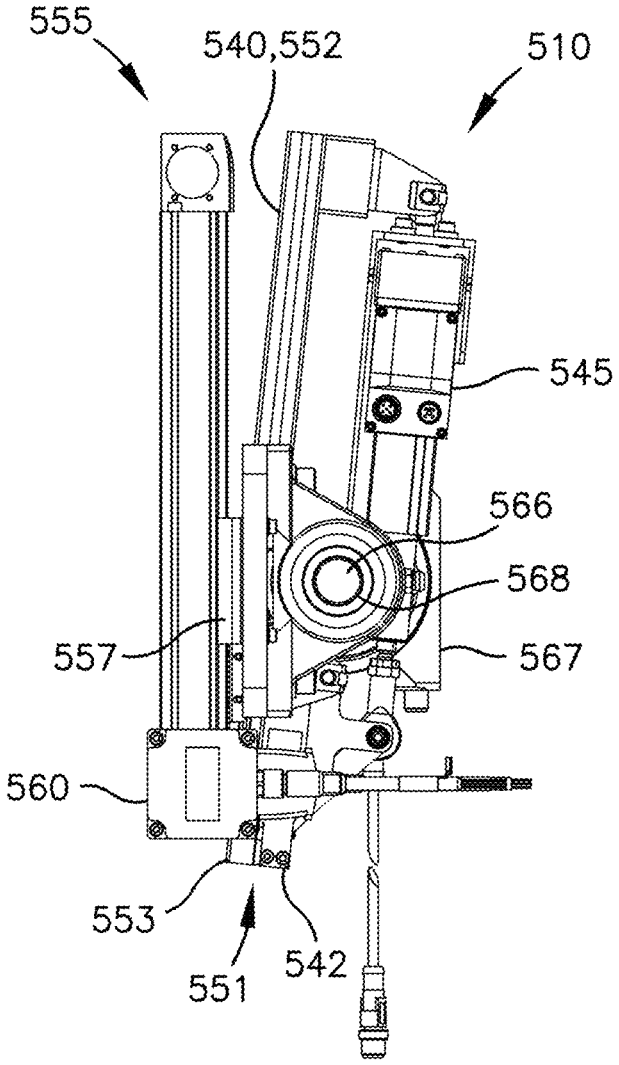
FIG. 13 is an elevation view of an embodiment of the width trim gripper assembly shown in FIG. 9, with the base member rotated more than 90° and the base member lowered on an elevator to lower the gripping device.

FIG. 9 shows a perspective view of the width trim gripper assembly 510, and FIGS. 10-13 show elevation views of the width trim gripper assembly 510 in various positions as described herein. The width trim gripper assembly 510 includes a package engaging plate or base member 540 that is engageable with a jaw member 542 driven by an actuator 545. The jaw member 542 is rotatably or pivotably positionable into an open or first position, shown in FIGS. 9 and 10, and into a closed or second position in engagement with the base member 540, as shown in FIGS. 11-13, to secure the open side of the package therebetween.

The base member 540 comprises a frame 552 with a plate 553 extending thereacross that is configured to engage or grip the package with the jaw member 542 when the jaw member 542 is pivoted into engagement therewith. The plate 553 and the jaw member 542 may be referred to together as a gripping device or a clamp 551. The gripping device 551 is configured to engage the open side of the package and pull the package from the rear side 111 to the front side 130 of the width trim conveyor run 502 of the width trim module 50 to minimize packaging material 15 used to form the package. In an embodiment, the width trim gripper assembly 510 is communicably coupled to from the processing system 70 and automated to grip and pull the package a distance across the width trim conveyor run 502 depending on or corresponding to a width of the order.

The jaw member 542 is rotatably mounted on or rotatably connected to the base member 540 on hinges or pivot mounts 563 at each end thereof. The actuator 545 is configured to open the jaw member 542, as shown in FIG. 10, to allow the open side of a package advancing onto the width trim conveyor run 502 to extend across the plate 553, and to close the jaw member 542, as shown in FIG. 11, when the package is in alignment with the width trim gripper assembly 510 to engage the open end of the package with the gripping device 551. With the open side of the package gripped between the jaw member 542 and plate 553, the base member 540 is moveable downward by being pivoted or rotated downward (FIG. 12) and/or being lowered downward (FIG. 13) to pull the package with the order therein across the width trim conveyor run 502 to the front side 130 of the item packaging machine 10 as described herein.

In an embodiment, the jaw member 542 includes an engaging surface or gripper 562 configured to provide a frictional surface, such as a surface formed by a rubber-type material, to prevent slippage to secure the open end of the package between the jaw member 542 and the plate 553. In an embodiment shown in FIG. 9, the gripper 562 is an elongated strip extending along the jaw member 542 where the jaw member 542 engages the packaging material 15. In an embodiment, the gripper 562 is formed from a plurality of pads or members positioned in spaced apart relationship along the jaw member 542.

In an embodiment shown in FIG. 12, the gripping device 551 has moved the package across the width trim module conveyor 500 by rotating the gripping device 551 about an axis of a shaft 566 that is rotatably secured to a rotary drive unit 567 (see FIG. 9). The shaft 566 is secured to the frame 552 and is rotatably secured within and extends between an aperture 568 in a bearing or mount 570 secured to a first carriage 557 and the rotary drive unit 567 secured to a second carriage 557. The shaft 566, the drive unit 567, and the mount 570 may be referred to as a gripping device rotation assembly 578. In an embodiment, the base member 540 and the jaw member 542, or the gripping device 551, are rotatable from a horizontal plane up to approximately 90° downward to move the package with the order therein up to approximately 11-inches laterally across the width trim conveyor run 502. In an embodiment, the package may be moved more or less depending on how far the gripping device 551 is moved downward and depending on a position and size of the components of the width trim gripper assembly 510. In an embodiment, the base member 540 and the gripping device 551 are rotatable more than 90° as shown in FIG. 13.

In an embodiment, the base member 540 is moveably secured to an elevator 555 on each side thereof, and the elevators 555 are configured to vertically move the base member 540 to pull the package secured by the gripping device 551 with the order therein across the width trim conveyor run 502 by vertically lowering the base member 540. The base member 540 may be lowered by the elevators 555 in a horizontal alignment (as generally shown in FIGS. 10 and 11) or in a rotated alignment relative to the axis extending through the shaft 566, as shown in FIG. 13. The extent of rotation of the gripping device 551 and/or lowering of the base member 540 is dependent on the width of the order to move the package adjacent the front side 130 of the width trim conveyor run 502.

In an embodiment shown in FIG. 9, the elevators 555 each comprise a carriage 557 that engages a linear motion device or actuator screw 558 supported in a vertical guide 559 to vertically position the base member 540 and the plate 553 relative to the elevators 555. A motor 560 drives the actuator screws 558 of each of the elevators 555 simultaneously via an actuator 561 that engages the elevators 555 on each side of the width trim gripper assembly 510. In an embodiment, the actuator 561 is positioned at a bottom of the elevators 555 to drive the actuator screws 558. In an embodiment, the actuator 561 is positioned at a top of the elevators 555 to drive the actuator screws 558. In an embodiment the motor 560 could be a servo or stepper motor.

Figure 14:
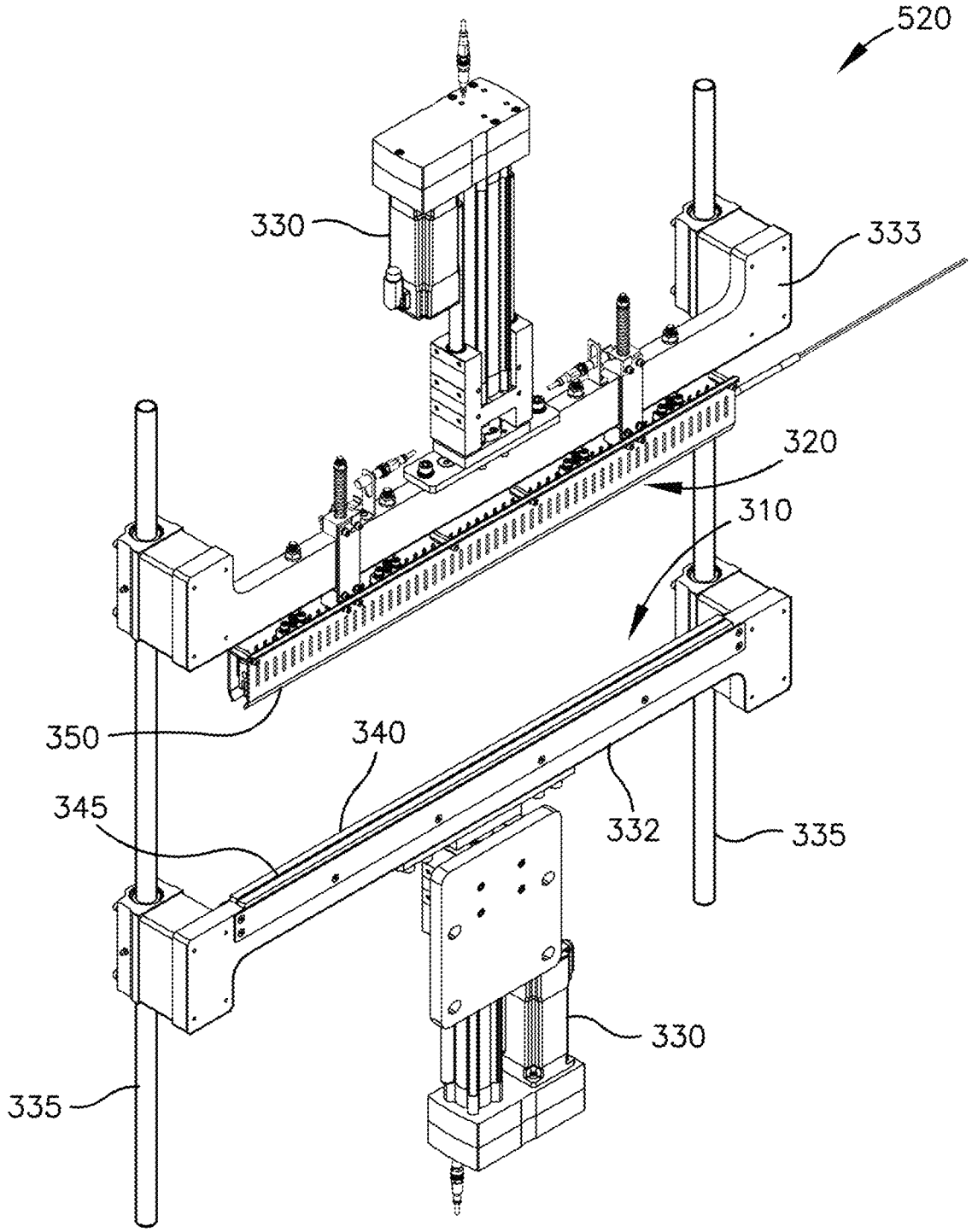
FIG. 14 is a perspective view of an embodiment of the side seal assembly of the width trim module shown in FIG. 1.

The side seal assembly 520 is shown in FIG. 14 and functions the same as, and has the same components as, the cross seal assembly 300 of FIG. 6 described herein. Components of the side seal assembly 520 that are the same or substantially similar to those described relative to the cross seal assembly 300 have the same reference numbers and descriptions.

As shown in FIGS. 7, 11, and 12, the side seal assembly 520 is positioned between the width trim gripper assembly 510 and the width trim module conveyor 500 such that the packaging material 15 extends over the anvil member 310 of the side seal assembly 520 when the package is engaged by the gripping device 551. The mounts 332 and 333 and the respective drive mechanisms 330 of the side seal assembly 520 are configured to vertically position the anvil member 310 and blade member 320 between the gripping device 551 of the width trim gripper assembly 510 and the width trim conveyor run 502 of the width trim module conveyor 500. In an embodiment, the anvil member 310 and the blade member 320 are configured to seal and cut the package material 15 extending between the order advanced onto the width trim conveyor run 502 and the gripping device 551 to minimize the packaging material 15 of the package.

The anvil member 310 is positioned just below the width trim conveyor run 502 and is configured to move upward a distance equivalent to half a height of the order as shown in FIG. 11. The gripping device 551 grabs or grips and pulls the package with the order across the width trim conveyor run 502 and over the anvil member 310. Thereafter, the blade member 320 of the side seal assembly 520 is lowered such that the blade 350 of the blade member 320 extends into the channel 345 of the anvil member 310 to cut the packaging material 15 extending over the anvil member 310, and a sealing assembly 547 engages the packaging material 15 to form a seal along the cut and unsealed side of the packaging material 15, as shown in FIG. 12. As best shown in FIGS. 11 and 12, and also applicable to the cross seal assembly 300, the blade 350 is configured to extend within the channel 345 of the seal bar 340 of the anvil member 310 to cut the packaging material 15 as the sealing assembly 547 approximately simultaneously forms a seal to seal the package. The blade member 320 includes a shroud or packaging support members 548 that compress or hold the packaging material 15 against the seal bar 340, and a heating apparatus 549, such as a cartridge heater, extending through the sealing assembly 547 that is configured to heat the sealing assembly 547 to form the seal extending across the cut and unsealed side of the packaging material 15. In an embodiment, the shroud 548 compresses or moves upward relative to the blade 350 so that the blade 350 and the sealing assembly 547 are able to engage the packaging material 15. In an embodiment, the blade 350 and the sealing assembly 547 move downward relative to the shroud 548 to engage the packaging material 15. In an embodiment, the anvil member 310 and the blade member 320 engage the packaging material 15 to cut and seal the package an equal distance from the top and bottom of the order to form a right-size or customized package.

Upon the final unsealed side of the package being sealed, the jaw member 542 rotatably disengages from the base member 540, and excess packaging material 15 or waste from the package falls, by gravity, to a bin (not shown) positioned thereunder to catch the waste, and/or onto a conveyor 610, shown in FIG. 1, that extends under the width trim gripper assembly 510 such that the waste is able to be conveyed away from the item packaging machine 10.

In a labeling step 650 of the item packaging machine 10, the sealed package containing the order is advanced onto a label application module 60 and a labeling assembly 530 applies a label to the package that may include the customer and/or item information. The labeling assembly 530 may include a label printer that prints or produces a label with the information thereon to be applied to the package via a tamp, a thermal printing device that applies the information directly to the package, another labeling device known in the art, or a combination thereof. In an embodiment, the width trim module 50 includes the labeling assembly 530 supported thereabove for applying a label to the package when the package is on the width trim conveyor run 502.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure. It will be understood that certain features and subcombinations are of utility and may be employed without reference to other features and subcombinations and are contemplated within the scope of the claims.

What is claimed is:

1. A width trim module for an item packaging machine, the width trim module configured to cut and seal packaging material including an upper layer and lower layer extending above and below an order respectively to form a package enveloping the order with the package including at least one closed side of packaging material opposite an unsealed side of packaging material, the width trim module comprising:

a conveyor having a conveyor run, wherein the package is advanced onto the conveyor run between a first side and a second side thereof;

a gripper assembly comprising gripping members configured to selectively engage the upper layer and lower layer of the packaging material along the unsealed side of the package, and, with the upper layer and lower layer of the packaging material engaged by the gripping members, the gripping members moveable relative to the conveyor run to pull the package engaged by the gripping members across the conveyor run, transverse to a direction of conveyance, toward the second side thereof; and a sealing assembly positioned between the conveyor and the gripper assembly, the sealing assembly configured to seal the upper layer and lower layer of packaging material together to form a longitudinal seal along the unsealed side of the package after the package has been pulled toward the second side of the conveyor run and to cut away a portion of each of the upper layer and lower layer of the packaging material extending on a side of the longitudinal seal opposite the order in the package.

2. The width trim module of claim 1, wherein the gripping members comprise a jaw pivotably mounted to a base, and the jaw is pivotable toward the base to engage and secure the unsealed side of the package between the jaw and the base.

3. The width trim module of claim 1, wherein the gripper assembly is rotatable about an axis to move the gripping members downward to pull the package across the conveyor.

4. The width trim module of claim 3, wherein the gripper assembly is mounted on a shaft driven by a rotary drive unit.

5. The width trim module of claim 1, wherein the gripper assembly is mounted on an elevator such that a position of the gripping members is vertically adjustable relative to the conveyor run.

6. The width trim module of claim 1, wherein the sealing assembly includes an anvil member and a blade member, each extending parallel to the conveyor run and the unsealed side of the package extends therebetween when the gripping members are in engagement with and have drawn the unsealed side of the package toward the second side of the conveyor run.

7. The width trim module of claim 6, wherein the anvil member and the blade member are vertically adjustable relative to the conveyor run.

8. The width trim module of claim 6, wherein the blade member is selectively heated.

9. An order packaging machine configured to form a package enveloping an order from a roll of packaging material having a center fold, the order packaging machine comprising:

an induction conveyor that advances each order into the order packaging machine;

a height sizing conveyor that advances each order to an order enveloping assembly including a first bracket that adjustably positions an upper layer of packaging material over the order and a second bracket that positions a lower layer of packaging material under the order, wherein the upper layer and lower layer of the packaging material at the height sizing conveyor together form a package with an unsealed leading edge, an unsealed trailing edge, and an unsealed side opposite a closed side of the package;

a first sealing assembly positioned between the height sizing conveyor and a package draw conveyor, wherein the upper layer and lower layer of packaging material of an immediately preceding package advanced past the first sealing assembly extends continuous with the upper layer and the lower layer of the packaging material of the package at the height sizing conveyor, respectively, and the first sealing assembly is configured to separate the upper layer and lower layer of packaging material between the immediately preceding package and the package at the height sizing conveyor and seal the unsealed leading edge of the upper layer and lower layer of packaging material of the package at the height sizing conveyor together to form a sealed leading edge and simultaneously seal a trailing edge of the upper layer and lower layer of packaging material of the immediately preceding package together;

a package draw member selectively engaging the package at the height sizing conveyor and advancing the package onto the package draw conveyor and past the first sealing assembly a longitudinal distance corresponding to a length dimension of the order, the package draw conveyor operable to convey the package to a width trim module;

the width trim module comprising gripping members configured to selectively engage the upper layer and lower layer of the packaging material along the unsealed side of the package, and, with the upper layer and lower layer of the packaging material engaged by the gripping members, the gripping members advanceable relative to a conveyor run of the width trim module to pull the package engaged by the gripping members across the conveyor run, transverse to a direction of conveyance, toward a second side thereof; and a second sealing assembly positioned between the conveyor run of the width trim module and the gripping members, the second sealing assembly configured to seal the upper layer and lower layer of packaging material together to form a longitudinal seal along the unsealed side of the package after the package has been pulled relative to the conveyor run of the width trim module and to cut away a portion of each of the upper layer and lower layer of the packaging material extending on a side of the longitudinal seal opposite the order in the package.

10. The order packaging machine of claim 9, wherein the gripping members pull the package laterally relative to the conveyor run corresponding to a distance based on a width dimension of the order.

11. The order packaging machine of claim 9, wherein the gripping members comprise a jaw pivotably mounted to a base, and the jaw is pivotable toward the base to engage and secure the unsealed side opposite the closed side of the package between the jaw and the base.

12. The order packaging machine of claim 9, wherein the gripping members are rotatable about an axis to move the gripping members downward to pull the package across the conveyor run.

13. The order packaging machine of claim 12, wherein the gripping members are mounted on a base mounted on a shaft driven by a rotary drive unit.

14. The order packaging machine of claim 9, wherein the gripping members are mounted on a base mounted on an elevator such that a position of the gripping members is vertically adjustable relative to the conveyor run.

15. The order packaging machine of claim 9, wherein the second sealing assembly includes an anvil and a blade, each extending parallel to the conveyor run and the unsealed side of the package extends therebetween when the gripping members are in engagement with the unsealed side of the package.

16. The order packaging machine of claim 15, wherein the anvil and the blade are vertically adjustable relative to the conveyor run.

17. The order packaging machine of claim 15 further comprising a heated sealing member adjacent the blade.

18. A method of forming a package around an order in an order packing machine configured to use a packaging material having a center fold, the method comprising:

determining a length dimension and a width dimension of the order;

advancing the order past an order enveloping assembly operable to advance an upper layer of packaging material over the order and a lower layer of packaging material under the order with the center fold of the packaging material extending across a first side of the order;

separating and sealing a leading edge of the upper layer and lower layer of packaging material to form a sealed leading edge of the package extending transverse to the first side of the order;

engaging the package proximate the sealed leading edge and advancing the package with the order enveloped therein onto a package draw conveyor a distance corresponding to the length dimension of the order;

separating and sealing a trailing edge of the upper layer and lower layer of packaging material to form a sealed trailing edge of the package extending transverse to the first side of the order;

advancing the package with the order enveloped therein onto a conveyor run of a width trim module such that the upper layer and lower layer of an unsealed side opposite the first side of the order are engageable by gripping members;

selectively engaging the upper layer and the lower layer of the unsealed side of the package by the gripping members;

moving the gripping members engaging the unsealed side of the package relative to the conveyor run to pull the package with the order enveloped therein across the conveyor run, transverse to a direction of conveyance, to advance the order contained in the package proximate to a cutting and sealing assembly and based upon the width dimension of the order; and advancing the cutting and sealing assembly into engagement with the upper layer and lower layer of the packaging material along the unsealed side of the package to form a side seal after the package has been pulled laterally relative to the conveyor run and cutting away a portion of each of the upper layer and lower layer of the packaging material extending on a side of the side seal opposite the order enveloped in the package.

19. The method of claim 18, further comprising rotating the gripping members about an axis to move the gripping members downward to pull the upper layer and lower layer of packaging material laterally relative to the conveyor run.

20. The method of claim 18, further comprising moving the gripping members vertically downward via an elevator to pull the upper layer and lower layer of packaging material laterally relative to the conveyor run.

21. The method of claim 18, further comprising vertically adjusting a position of an anvil and a blade of the cutting and sealing assembly relative to the conveyor run to position the anvil at a height above the conveyor run which is approximately half a height dimension of the order.

* * * * *